US006266827B1

(12) United States Patent
Lampe et al.

(10) Patent No.: US 6,266,827 B1
(45) Date of Patent: Jul. 31, 2001

(54) IMPACT PROTECTION HEADGUARD

(75) Inventors: John K. Lampe; Robert C. Long; Kevin T. Fenton; George C. Halvorson, all of St. Paul; Seth G. Halvorson, Minneapolis, all of MN (US)

(73) Assignee: Soccer Docs, Inc., St. Paul, MN (US)

( * ) Notice: Subject to any disclaimer, the term of this patent is extended or adjusted under 35 U.S.C. 154(b) by 0 days.

(21) Appl. No.: 09/581,375

(22) PCT Filed: Dec. 11, 1998

(86) PCT No.: PCT/US98/26507

§ 371 Date: Jul. 28, 2000

§ 102(e) Date: Jul. 28, 2000

(87) PCT Pub. No.: WO99/29199

PCT Pub. Date: Jun. 17, 1999

Related U.S. Application Data

(60) Provisional application No. 60/100,111, filed on Sep. 14, 1998, provisional application No. 60/072,527, filed on Jan. 26, 1998, and provisional application No. 60/069,429, filed on Dec. 12, 1997.

(51) Int. Cl.[7] ..... A42B 3/00

(52) U.S. Cl. ..... 2/414; 2/417; 2/425

(58) Field of Search ..... 2/417, 425, 410, 2/411, 412, 414, 418, DIG. 11

(56) References Cited

U.S. PATENT DOCUMENTS

| | | | |
|---|---|---|---|
| D. 339,677 | 9/1993 | Kang | D2/512 |
| D. 370,309 | 5/1996 | Stucky | D29/102 |
| D. 410,768 | 6/1999 | Hirsh | D29/102 |
| 532,567 | 1/1895 | Larwood, Jr. . | |
| 2,969,547 | 1/1961 | Dye | 2/3 |
| 3,171,133 | 3/1965 | Steffen | 2/3 |
| 3,725,956 | 4/1973 | Reisen | 2/200 |
| 3,784,984 | 1/1974 | Aileo | 2/3 R |
| 3,992,721 | 11/1976 | Morton | 2/3 R |
| 4,023,209 | 5/1977 | Frieder, Jr. et al. | 2/6 |
| 4,044,400 | 8/1977 | Lewicki et al. | 2/421 |
| 4,058,854 | 11/1977 | Rhee | 2/412 |
| 4,062,067 | 12/1977 | Franzen | 2/410 |

(List continued on next page.)

FOREIGN PATENT DOCUMENTS

| | | | |
|---|---|---|---|
| 2 202 729 | 10/1988 | (GB) | A42B 3/00 |

OTHER PUBLICATIONS

Seven Photographs of "Glibert Rugby" head protector, date unknown.

Seven Photographs of "CCC" head protector, date unknown.

Fellow, Fishbein, "Can Sports–Minded Kids Have Too Many Helmets?", *Medical News and Perspectives*, vol. 275, No. 18, p. 1391, May 8, 1996.

Tysvaer, Alf Thorvald, Head and Neck Injuries in Soccer, Impact of Minor Trauma, *Sports Medicine*, vol. 14, No. 3, p. 200–213, 1992

*Primary Examiner*—Rodney Lindsey
(74) *Attorney, Agent, or Firm*—Michael S. Sherrill

(57) ABSTRACT

Impact protection headguards for athletics and in particular soccer players are provided. In one embodiment, a protective headguard is provided that includes a central pad for covering a portion of a forehead of a wearer. The central pad has a first side and a second side, and a first and second padded rib extending from each side of the central pad. The distal ends of the first and second padded ribs on each side are connected to form side portions that extend rearward from the central pad for covering sides of the head of the wearer. The headguard also includes a rear pad for covering an occipital bone of the wearer and an adjustment strap system which secures the side portions of the central pad to the rear pad.

30 Claims, 21 Drawing Sheets

U.S. PATENT DOCUMENTS

| | | | |
|---|---|---|---|
| 4,075,717 | 2/1978 | Lemelson | 2/412 |
| 4,239,106 | 12/1980 | Aileo | 206/223 |
| 4,290,149 | 9/1981 | Aileo | 2/414 |
| 4,317,239 | 3/1982 | Bryksa | 2/411 |
| 4,345,336 | 8/1982 | Plastino | 2/187 |
| 4,354,284 | 10/1982 | Gooding | 2/413 |
| 4,398,306 | 8/1983 | Gooding | 2/421 |
| 4,404,690 | 9/1983 | Farquharson | 2/420 |
| 4,443,891 | 4/1984 | Blomgren et al. | 2/414 |
| 4,481,681 | 11/1984 | Hankin | 2/197 |
| 4,484,364 | 11/1984 | Mitchell et al. | 2/413 |
| 4,539,715 | 9/1985 | Clement | 2/420 |
| 4,558,470 | 12/1985 | Mitchell et al. | 2/414 |
| 4,581,773 | 4/1986 | Cunnane | 2/204 |
| 4,612,672 | 9/1986 | Schrack | 2/68 |
| 4,613,993 | 9/1986 | Steele et al. | 2/411 |
| 4,646,367 | 3/1987 | El Hassen | 2/411 |
| 4,698,852 | 10/1987 | Romero | 2/171 |
| 4,706,305 | 11/1987 | Cho | 2/425 |
| 4,710,985 | 12/1987 | Dubner et al. | 2/425 |
| 4,766,614 | 8/1988 | Cantwell et al. | 2/414 |
| 4,768,231 | 9/1988 | Schrack | 2/12 |
| 4,790,035 | 12/1988 | Whyte | 2/207 |
| 4,827,537 | 5/1989 | Villa | 2/410 |
| 4,843,642 | 7/1989 | Brower | 2/6 |
| 4,864,662 | 9/1989 | Frank | 2/183 |
| 4,910,804 | 3/1990 | Lidgren | 20/209 |
| 4,947,488 | 8/1990 | Ashinoff | 2/181 |
| 4,982,451 | 1/1991 | Graham | 2/410 |
| 5,012,533 | 5/1991 | Raffler | 2/420 |
| 5,042,093 | 8/1991 | Legendre | 2/419 |
| 5,044,016 | 9/1991 | Coombs | 2/414 |
| 5,075,903 | 12/1991 | Richoux | 2/411 |
| 5,081,717 | 1/1992 | Shedd et al. | 2/199 |
| 5,083,321 | 1/1992 | Davidsson | 2/421 |
| 5,173,970 | 12/1992 | Shifrin | 2/410 |
| 5,177,815 | 1/1993 | Andujar | 2/411 |
| 5,184,354 | 2/1993 | Alfaro et al. | 2/425 |
| 5,271,103 | 12/1993 | Darnell | 2/418 |
| 5,315,718 | 5/1994 | Barson et al. | 2/418 |
| 5,361,420 | 11/1994 | Dobbs et al. | 2/425 |
| 5,392,468 | 2/1995 | Leddick, III | 2/424 |
| 5,421,035 | 6/1995 | Klose et al. | 2/411 |
| 5,437,064 | 8/1995 | Hamaguchi | 2/414 |
| 5,450,631 | 9/1995 | Egger | 2/425 |
| 5,504,945 | 4/1996 | Purnell | 2/425 |
| 5,511,250 | 4/1996 | Field et al. | 2/418 |
| 5,515,546 | 5/1996 | Shifrin | 2/410 |
| 5,519,895 | 5/1996 | Barnes, Jr. | 2/422 |
| 5,535,454 | 7/1996 | Ryan | 2/425 |
| 5,544,367 | 8/1996 | March, II | 2/410 |
| 5,551,094 | 9/1996 | Navone | 2/421 |
| 5,615,419 | 4/1997 | Williams | 2/411 |
| 5,628,071 | 5/1997 | Nezer | 2/410 |
| 5,638,551 | 6/1997 | Lallemand | 2/421 |
| 5,640,721 | 6/1997 | Jackson | 2/171 |
| 5,659,900 | 8/1997 | Arney et al. | 2/417 |
| 5,661,854 | 9/1997 | March, II | 2/410 |
| 5,680,656 | 10/1997 | Gath | 2/424 |
| 5,701,609 | 12/1997 | Bridges | 2/422 |
| 5,704,072 | 1/1998 | Garneau | 2/421 |
| 5,774,901 | 7/1998 | Minami | 2/421 |
| 5,790,988 | 8/1998 | Guadagnino, Jr. et al. | 2/411 |
| 5,815,847 | 10/1998 | Holden, Jr. | 2/418 |
| 5,862,528 | 1/1999 | Saijo et al. | 2/411 |
| 5,882,205 | 3/1999 | Peterson | 434/251 |
| 5,930,841 * | 8/1999 | Lampe et al. | 2/411 |
| 5,946,734 | 9/1999 | Vogan | 2/412 |
| 5,963,989 | 10/1999 | Robertson | 2/411 |
| 6,000,062 | 12/1999 | Trakh | 2/171 |
| 6,065,159 | 5/2000 | Hirsh | 2/425 |

* cited by examiner

IMPACT PROTECTION HEADGUARD

This application is a 371 of PCT/US98/26,507 filed Feb. 11, 1998 which claims benefits to U.S. provisional application Ser. No. 60/069,429 filed Dec. 12, 1997 which claims benefit to U.S. provisional application Ser. No. 60/072,527 filed Jan. 26, 1998, which claims benefit to U.S. provisional application Ser. No. 60/100,111 filed Sep. 14, 1998.

FIELD OF THE INVENTION

The present invention generally relates to protective headguards for athletics, and more particularly, relates to an impact protective headguard for soccer players.

BACKGROUND OF THE INVENTION

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, soccer players have not worn any protective headgear. This is probably the case for two main reasons. First, soccer players or organizers of the game may not have sensed a need to use headgear because injuries to the head may not have seemed as commonplace as in sports such as football, hockey, and bicycling. Second, soccer is one of the few sports where the head itself is intentionally and legitimately used to strike the ball. This requires considerable muscle coordination and use of the senses of sight and touch. An improperly constructed piece of headgear may hamper a player's ability to head the ball properly.

Recent medical research has demonstrated that head injuries may be more prevalent in soccer than previously thought. Several studies have suggested that soccer players may suffer minor trauma from repeatedly heading the ball. This injury has been analogized to pugilistic dementia, the harm that boxers suffer from repeated strikes to the head in boxing. Alf Thorvald Tysvaer, Head and Neck Injuries in Soccer - Impact of Minor Trauma, *Sports Medicine,* 14(3): 200–213 (1992). This danger of trauma in soccer may be greater for children. Their skills at heading are less well honed. Their bodies may not be developed enough to withstand or counteract the blow caused by a ball. Id. at 210. Therefore, at least from a safety standpoint, use of headgear by soccer players seems advisable.

The unique demands of the sport of soccer require unique headgear. Although multipurpose protective headgear for sports are being developed, most forms of headgear for use in team sports are intended for one sport and should not be used in other activities. Thomas B. Cole, Can Sports Minded Kids Have Too Many Helmets?, *Journal of the American Medical Association,* 275(18):1391 (May 8, 1996). A brief review of patents for headgear constructed for other sports shows how such headgear would not meet the specialized needs of soccer players. For example, football and hockey helmets are ill-suited for soccer. Their bulk would likely discourage soccer players unaccustomed to helmets from wearing them. In addition this bulk and the hard, sometimes uneven surfaces of such helmets would make it very difficult to control the direction and distance of a headed ball. Finally, other unprotected soccer players might suffer injuries caused by the hard-surfaced headgear of the wearer. See, e.g., U.S. Pat. No. 4,404,690 (hockey helmet).

Other helmets would also not work effectively as soccer headgear. Bicycle helmets are light but would make control of the ball difficult; they are built to withstand one substantial blow; and their ventilation systems would likely not be effective in soccer. See, e.g., U.S. Pat. No. 5,450,631. Wrestling headgear protects the ears and only incidentally, if at all, protects the surfaces of the head. See, e.g., U.S. Pat. No. 5,361,420.

U.S. Pat. No. 4,698,852 illustrates protective headgear specifically designed for use in soccer. This headgear, however, has several shortcomings. The headband shape of the headgear protects only the forehead, neglecting other parts of the head which may be used, properly and improperly, to strike balls. The headband shape moreover creates a ridge at the edge of the headband which may misdirect a headed ball. In addition, the materials and retention system of this headgear likely would cause the headgear to slip up or down on the wearer's head or, if tightened, may strain the wearer's head.

SUMMARY OF THE INVENTION

Generally, the present invention relates a headguard for athletics and in particular soccer players. In accordance with one embodiment of the invention, a protective headguard is provided that includes a central pad for covering a portion of a forehead of a wearer. The central pad has a first side and a second side, and a first and second padded rib extending from each side of the central pad. The distal ends of the first and second padded ribs on each side are connected to form side portions that extend rearward from the central pad for covering sides of the head of the wearer. The headguard further includes a rear pad that covers an occipital bone of the wearer. An adjustment strap system secures the side portions of the central pad to the rear pad.

A method of manufacturing a protective headguard is also provided. The method includes forming a planar pad having a central pad and first and second padded ribs extending from each side of the central pad. Further, the first and second padded ribs on each side are bent to contact a distal end of one of the first padded ribs with a distal end of a respective one of the second padded ribs. The contacted distal ends of respective first and second padded ribs are secured to form a multidimensional pad from the planar pad having side portions extending rearward of the central pad for covering sides of the head of a wearer.

The above summary of the present invention is not intended to describe each illustrated embodiment of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
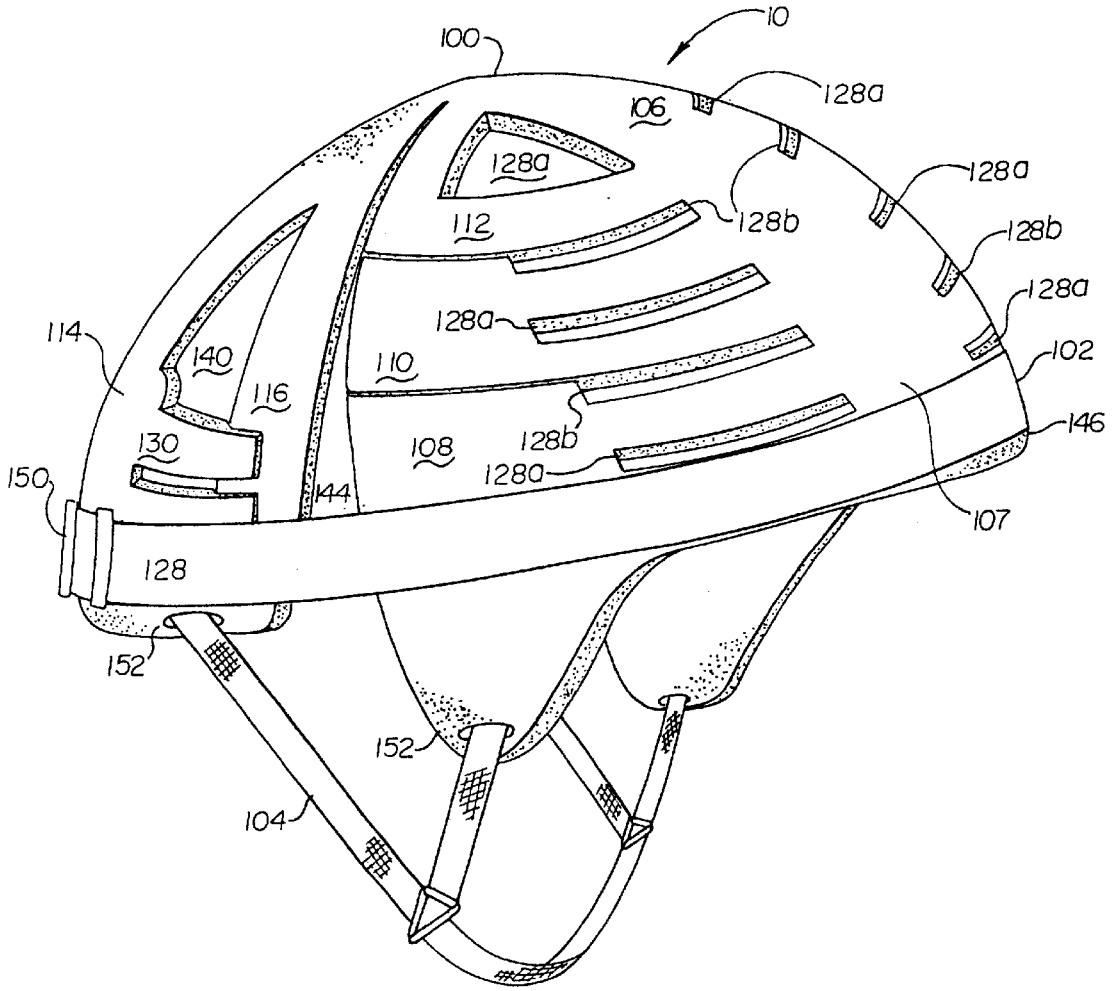
FIG. 1 is a perspective view of an exemplary headguard in accordance with one embodiment of the invention.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims. On the contrary, the intention is to cover all modifications, equivalents, and alternatives falling within the spirit and scope of the invention as defined by the appended claims.

DETAILED DESCRIPTION

The present invention is believed to be applicable to a number of different sports, and is particularly suited to soccer where players intentionally strike the ball with their head. While the present invention is not so limited, an appreciation of various aspects of the invention will be gained through a discussion of the exemplary embodiments in connection with the examples provided below.

Figure 2:
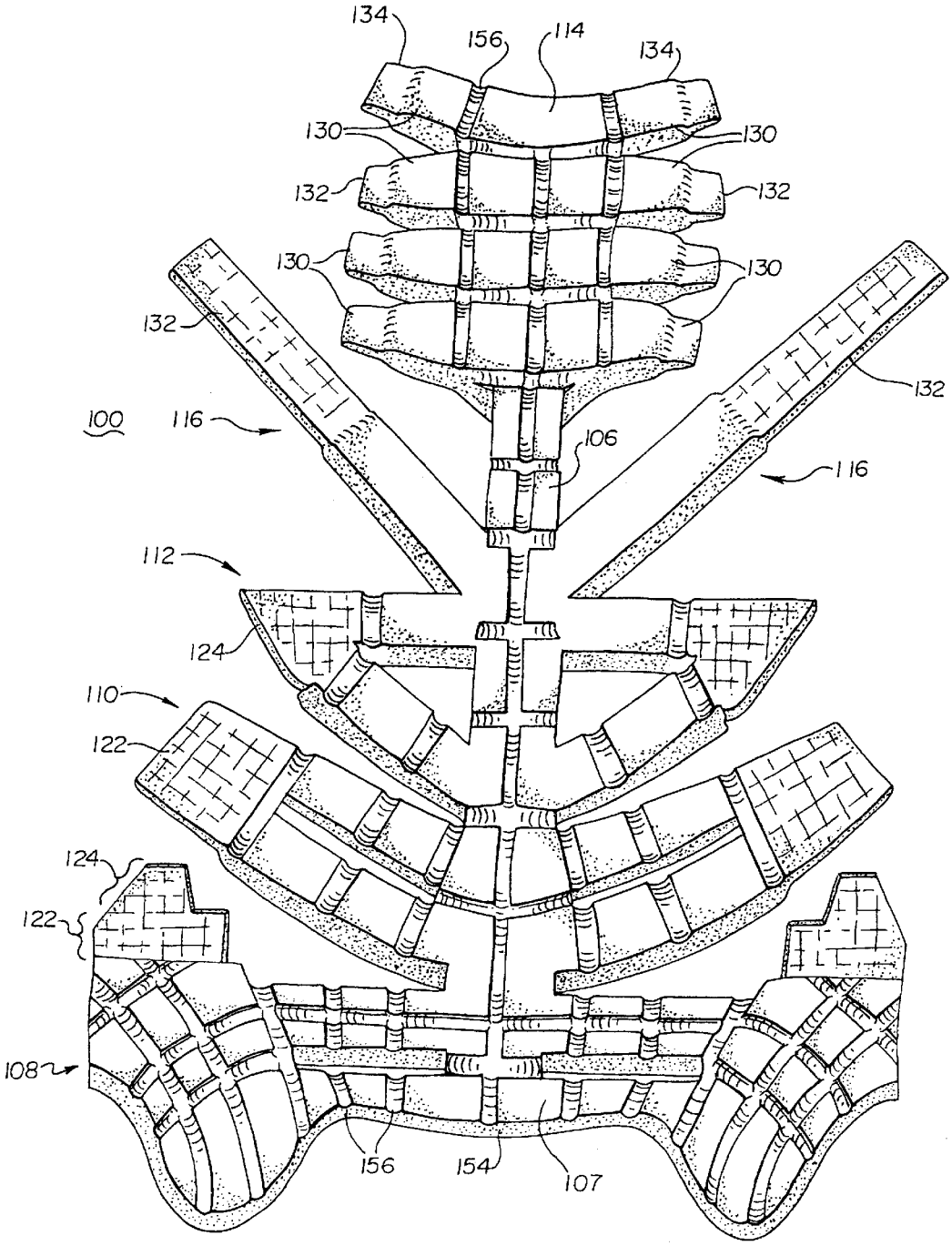
FIG. 2 is a bottom view of the headguard of FIG. 1.

FIGS. 1 and 2 illustrate one exemplary headguard in accordance with one embodiment of the invention. The headguard 10 includes a pad 100, a head adjustment strap 102, and a chin strap 104. The pad 100 typically includes a spine 106, a front panel 108, a mid panel 110, a crown panel 112, two rear branches 116, and a rear panel 114. The front panel 108 and rear panel 110 form branches extending from a central pad portion 107 provided for covering a portion of a wearer's forehead. All of these pieces of padding are typically made of a shock-absorbing material such as foam which dissipates the force to the wearer's head when struck by an object and which is positioned on the headguard 10 to protect the regions of the wearer's head which may strike objects during the course of play. For example, the padding may cover the front, top, back and side areas of a wearer's head. This positioning of the padding is particularly suited for soccer players, who often use these areas of the head when striking a soccer ball.

The padding is typically sufficiently flexible so as to conform to unique head shapes and sizes. The position of the padding may be suitably selected in consideration of the particular environment in which the headguard is worn. For example, when used during the play of soccer, the padding may be positioned to provide a relatively uniform exterior surface over portions of a player's head which generally come in contact with a soccer ball, thus allowing greater control of the ball.

The thickness of the padding may be suitably selected in consideration of the portion of the head on which the padding is to cover as well as in consideration of the particular environment in which the headguard is worn. For example, the thickness of the padding may vary between the top, front, side, and back portions of the padding. Pad thickness around, for example, ⅜ to ⅝ inches, would be suitable for many applications.

The padding may further include apertures, such as channels, holes, or similar features, to circulate air through and ventilate moisture from the headguard. Suitable padding material includes solid and/or laminated foam, formed from plastic, for example.

In the exemplary embodiment, the spine 106, to which all of the panels attach, runs from the forehead over the crown to the back of the head, just below the occipital bone; the front panel 108 covers generally the forehead and the temples; the mid panel 110 covers generally the front part of the head just above the forehead to the area just above the temples; the crown panel 112 covers the crown of the head, two rear branches 116 run from the crown of the head to the rear panel 114; the rear panel 114 generally covers the back of the head near the occipital bone.

In this exemplary embodiment, the pad 100 is molded as a unified, generally flat (i.e., planar) piece, as illustrated in FIG. 2. During assembly, parts of the pad 100, as will be discussed below, are fastened together to create the multi-dimensional headguard 10 shown in FIG. 1 from the flat piece of padding. The fastening typically occurs at zeros areas which are areas of thinner foam. Because zero areas are thinner, the overall thickness of the headguard can remain generally uniform even when the zero areas are fastened together in an overlapping position.

The pad 100 may have fabric laminated to the exterior surface and the interior surface of the pad 100. The exterior fabric typically is durable and provides a surface that allows good control of the ball when heading the ball but is not so tactile that the headguard will grip objects, including the soccer ball, or extremities of other players.

Figure 3:
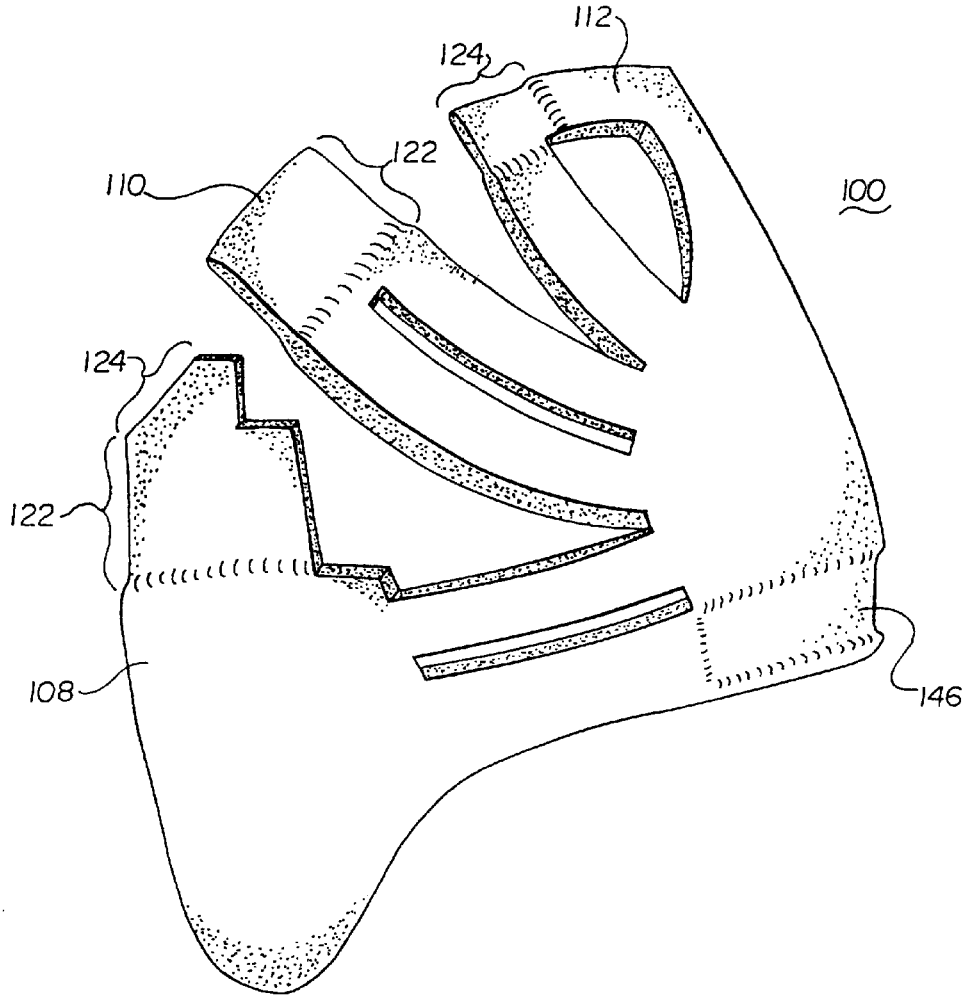
FIG. 3 shows a front panel portion of the headguard of FIG. 1.

FIG. 3 illustrates a partial exterior view of the pad 100. In assembling the headguard 10, the left and right distal ends of the front panel 108 are bent and fastened by stitches or other fastening mechanisms to the left and right distal ends of the mid panel 110. The fastening occurs at the zero areas 122 of the front and mid panels 108 and 110, as best illustrated in FIG. 3. When those portions of the zero areas 122 of the front and mid panel 108 and 110 are fastened together, the headguard 10 curves in a way that conforms to the shape of the forehead and temples.

After fastening the front and mid panels, part 124 of the zero area 122 of each front panel 108 remains open. These remaining exposed portions 124 of the zero areas 122 are fastened to respective zero areas 124 of the crown panel 112. When the zero areas 122 and 124 at the ends of the front, mid, and crown panels 108, 110, 112 are fastened together, the headguard 10 curves in a way that conforms to the shape of the front part of the head.

Open areas where padding does not cover the head provide ventilation and increase the plasticity of the padding. In this embodiment, these open areas are created in two ways. First, front vents 128*a* (shown in FIG. 1) are molded into the front and mid panels 108 and 110 and are molded into the crown panel 112. In addition, front vents 128*b* (shown in FIG. 1) are created by seams between the front and mid panels 108 and 110 and between the mid and crown panels 110 and 112 when attached.

Figure 4:
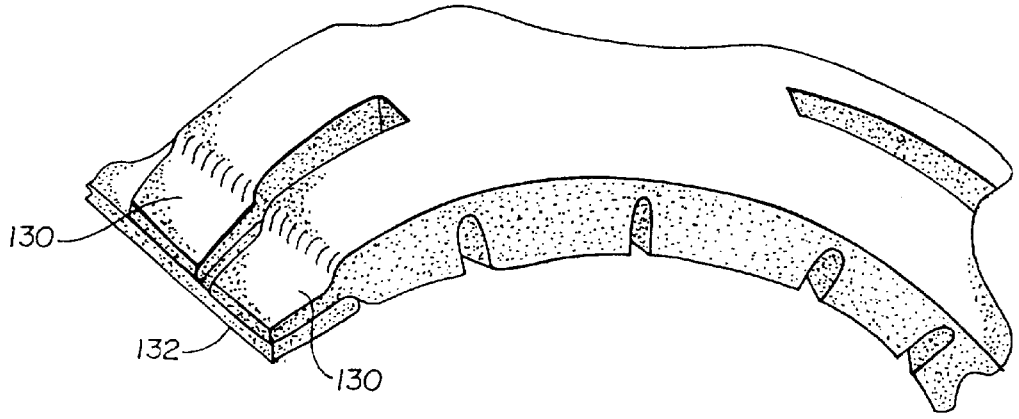
FIG. 4 is a perspective view of a rear pad portion of FIG. 1.
Figure 5:
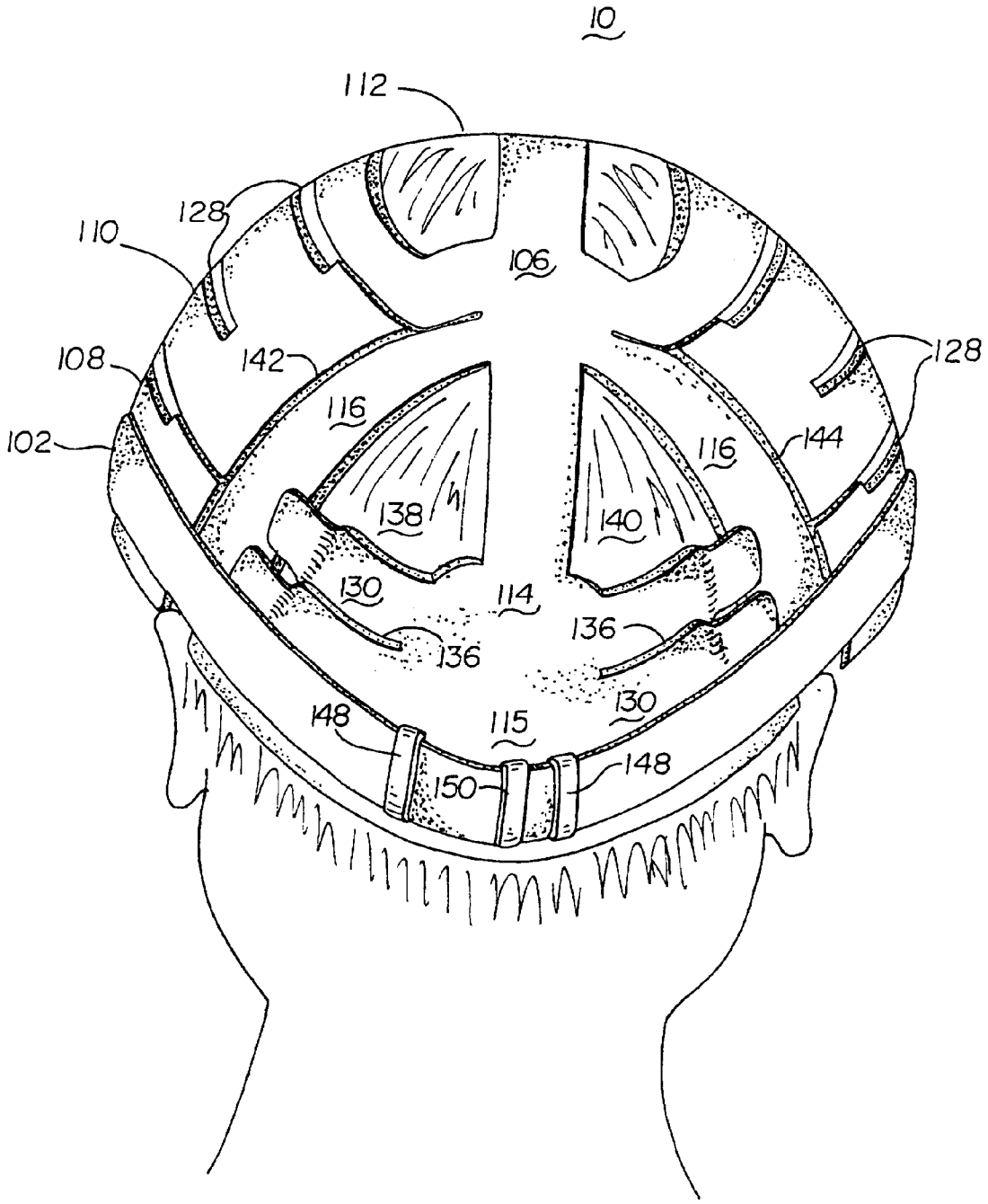
FIG. 5 is a rear view of the exemplary headguard of FIG. 1 shown worn by a user.

FIG. 5 is a rear view of the headguard 10. As best illustrated in FIG. 5, after assembly of the front part of the headguard 10, the rear panel 114 is fastened to the rear branches 116. This fastening typically occurs at zero areas 132 on the rear branches 116 (shown in FIG. 2) and at the ends of rear ribs 130 (shown in FIGS. 2 and 4) located on rear panel 114. The rear ribs 130 jut out from both the left and right side of the center pad portion 115 of the rear panel 114 that covers the occipital bone. The zero areas 132 of the rear ribs 130 and the rear branches 116 may be fastened in the same way as the zero areas 122 and 124 of the front, mid, and crown panels 108, 110, and 112.

The zero areas of the panels and ribs and branches may, as an alternative to stitching, be fastened by means of an adjustable fastener such as a hook and loop fastener, for example, Velcro™. If this is done, the size and shape of the headguard 10 may be further adjusted to fit the unique sizes and shapes of different heads.

The bottom rear ribs 134 (and/or optionally the top rear ribs) may be molded at an angle to the other ribs as best illustrated in FIG. 2. When the angled ribs and drawn parallel to the other rear ribs during assembly, the rear panel 114 bulges and increases the cupping of the rear panel 114 to the shape of the occipital bone. In addition, cupping of the rear panel 114 can be increased by making the ends of the rear ribs 130 that attach to the rear branches 116 narrower than the ends that are molded to the center portion 115 or the rear panel 114. This permits the rear ribs 130 to be drawn closer at the ends attached to the rear branches 116 and causes bulging of the padding at the point where the rear ribs 134 are molded to the center portion 115. Finally, varying the lengths of the rear ribs 130 may also increase the cupping to accommodate the occipital bone.

As illustrated in FIG. 5, gaps between the rear ribs 130 form rear vents 136 which increase ventilation and allow the foam to bend into the rounded shape that conforms to the back of the head without stressing the foam or causing bulging of the foam in unintended spots.

Optionally, the bottom rear rib 134 may be wider than the other ribs. This extra width permits different sized headguards to be made without creating more than one mold. For larger headguards to fit larger heads, the full width of the bottom rear rib 134 may be left intact. For smaller headguards to fit smaller heads, the width of the rib may be reduced in the assembly process.

The rear panel 114 is designed to protect the head from minor blows to the back of the head. Since the back of the head can be vulnerable to injury, this part of the headguard may be relatively thick as compared to the padding thickness of the front and mid panels 108 and 110, for example.

Figure 6:
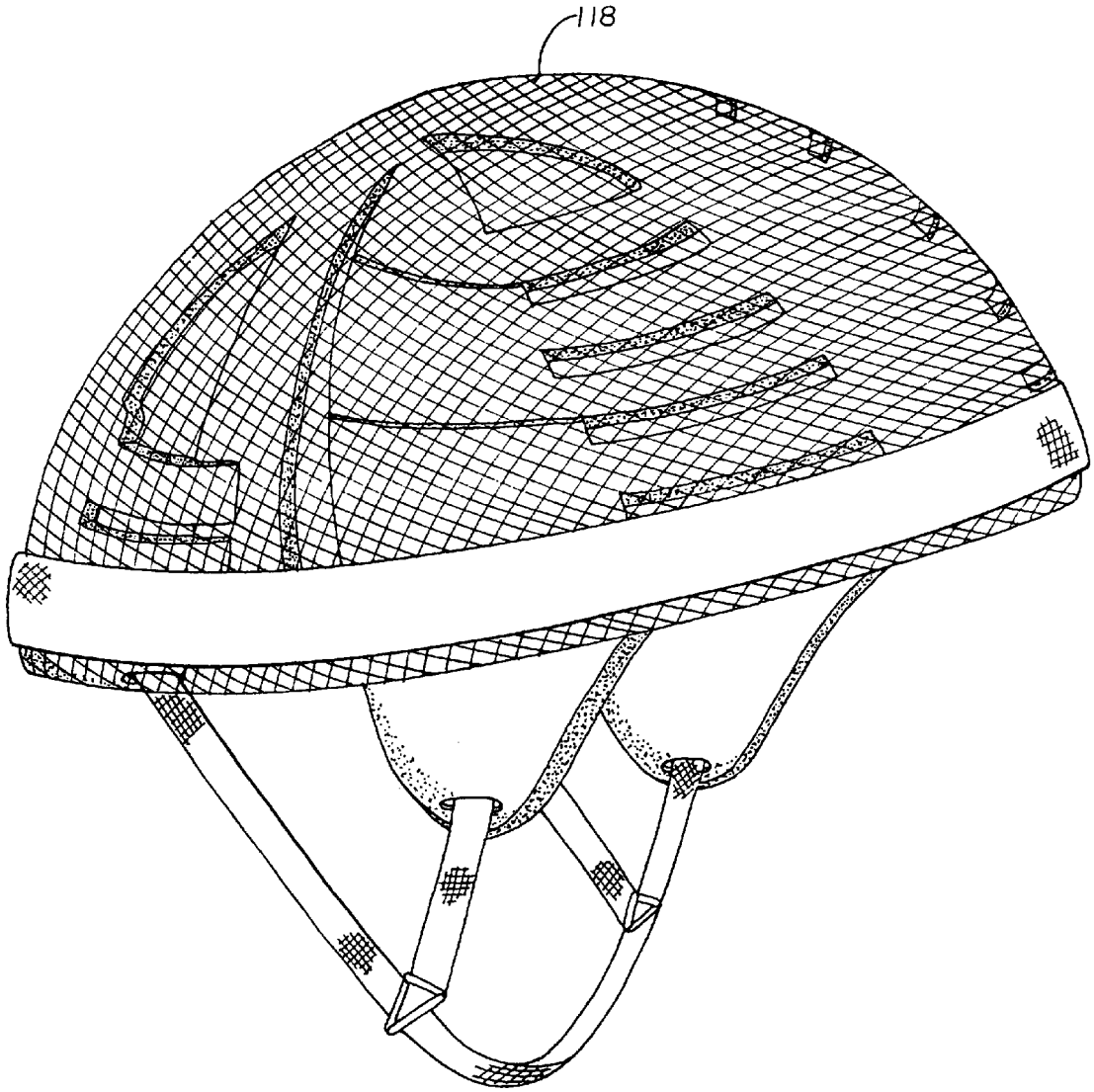
FIG. 6 is a perspective view of an exemplary headguard in accordance with one embodiment of the invention.

When the rear branches 116 are attached, two roughly triangular areas 138 and 140 of the headguard, above the rear panel 114, between the rear branches 116, and on either side of the spine 106 may remain open as illustrated in FIG. 5. The corresponding area of the head should be less vulnerable to injury and therefore need less protection. In addition, the openings may increase the ventilation. Loose fitting fabric 118 may cover the entire exterior as shown in FIG. 6 or some portion of the headguard.

Expansion joints 142 and 144, shown in FIGS. 1 and 5, may positioned to lie just behind the ears on both sides of the head by the front edge of the rear branches 116 and the rear edges of the front, mid, and crown panels 108, 110 and 112. The expansion joints 142 and 144 can expand or contract to fit uniquely shaped and sized heads. The head adjustment strap 102 maintains the proper size and fit during play. Elastic fabric may cover the expansion joints 142 and 144.

In alternative embodiments, various modifications may be made to increase ventilation. For example the triangular areas 138 and 140 above the rear panel 114 may be enlarged; the number of rear ribs 130 may be reduced, the spine 106 may be reduced in width, the crown panel 112 eliminated, the mid panel 110 eliminated, the portion of the front panel 108 covering the temples may be eliminated; or the vents increased in size.

In this embodiment the head adjustment strap 102 (shown in FIGS. 1 and 6), made of a stretchable material, runs from the forehead to the back of the head. In the forehead area, the adjustment strap 102 may rest in a slight recess 146 in the padding of the front panel 108 as illustrated in FIG. 3. The recess 146 serves to maintain the position of the adjustment strap 102. The head adjustment strap 102 runs along the left and right sides of the front panel 108 of the headguard 10 over approximately the top-third of an open area for the ears. The ears are typically recessed in a seam created by the expansion joints 142 and 144.

As best shown in FIG. 5, the head adjustment strap 102 typically runs through two back loops 148 located on the rear panel 114. The back loops 148 may be pass-throughs which are integrated into the foam/padding during the molding process or may be fabric sewn onto the rear panel 114. The back loops 148 typically maintain the position of the head adjustment strap 102 so that it runs to a point just below the occipital bone where an adjustable fastener 150 completes the loop of the strap around the head. Mild tension on the head adjustment strap 102 typically holds the headguard 10 in place on the forehead above the brow and below the protrusion on the frontal bone and on the back of the head just below the occipital bone. This location of the strap 102 is desirable because the strap 102 will tend to shift or slide less. As a result, only mild tension on the adjustment strap 102 is typically necessary to keep the headguard in place. This mild tension reduces fatigue associated with a headguard that fits too tightly. The head adjustment strap 102 can expand or contract the expansion joints 142 and 144 and thereby permit the wearer to increase or decrease the size of the headguard 10 to fit the unique characteristics of the wearer's head.

A chin strap 104 may be attached to the headguard 10 to better retain the headguard on the head during play. As illustrated in FIG. 1, the chin strap 104 may be attached to the headguard 10 in four places, e.g., to the left and right sides of the rear panel 114 and to the left and right sides of the front panel 108. This may be done, for example, by running the strap 104 through slots 152 in the rear panel 114 and panel 108 created during the molding process.

Figure 7:
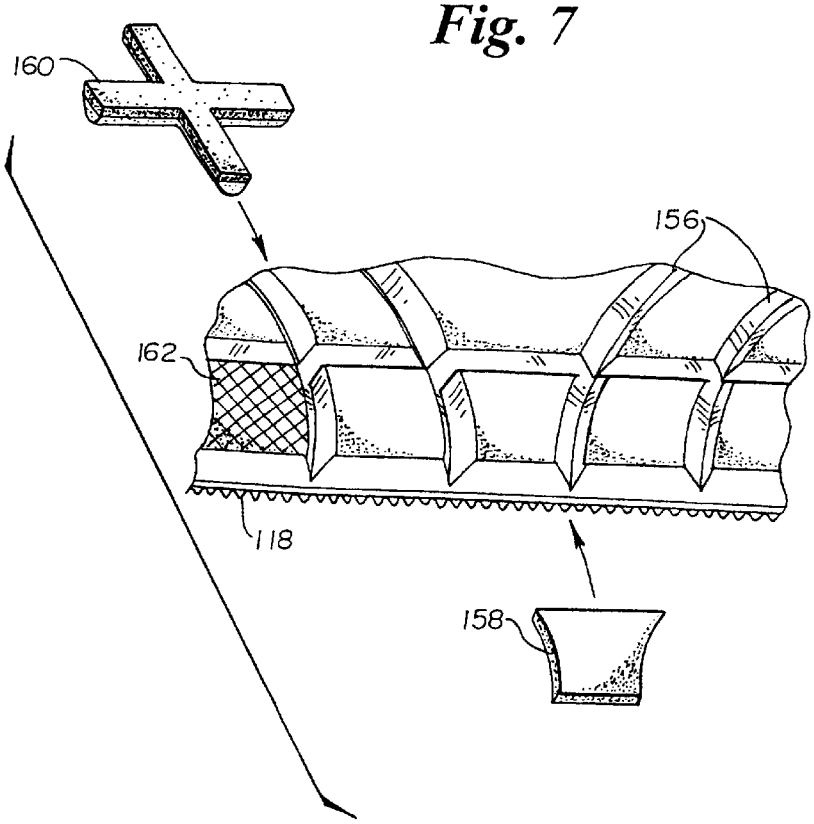
FIG. 7 is a bottom view of an exemplary interior for use with the headguard of FIG. 1.

In this embodiment, the interior of the headguard which comes in contact with the head typically includes pillows 154, as best illustrated in FIGS. 2 and 7. The pillows 154 are raised portions of the foam separated by interior channels 156. The channels 156 may run in different directions to create pillows 154 of uniform height but of varying widths with generally three to four sides. The channels 156 may be molded into a v-shape or other shapes that makes the channel 156 wider at the point closest to the head of the wearer, as illustrated in FIG. 7. This v-shape allows the parts of the headguard 10 to be more easily bent in shapes that conform to the head. It also allows the headguard 10 to be constructed from a thicker piece of foam to enhance the energy adsorbing capabilities of the headguard while still providing the flexibility of a thinner piece of foam which bends more easily into shapes that can conform to the head. The channels 156 also provide ventilation at the point where the headguard rests directly on the head. The channels 156 may advantageously be positioned so that air is directed to the vents to improve circulation.

Ventilation may be further increased in numerous ways as shown in FIG. 7. First small cloth pieces 158 with adhesive backing or Velcro™, for example, may be attached to the pillows 154 in order to provide a sweat-absorbing layer between the pillows 154 and the head. Second, a light-weight, breathable and washable, inner cloth piece may be worn on the head to provide space between the foam of the pillows 154 and the head. Third, open-cell foam pieces 160 may be located on the interior of the headguard 10 in order to decrease the contact between the pillows 154 and the head. For example, open cell foam pieces 160 may have a v-shaped bottom configured to wedge into v-shaped channels 156. In this way when an object strikes the headguard 10, the open cell foam pieces 160 compress and the pillows 154 come in contact with the head and absorb and distribute the impact. Fourth, soft, sweat absorbent cloth may be laminated to the surface of the pillows 154 with the same general effect as the small cloth pieces 158. Finally, the surface of the pillows 154 may be roughened with cross-hatching 162 to reduce contact between the foam pad 100 and the skin.

Use of the headguard will be described with reference to FIGS. 1 and 5. In use, a wearer typically slips the headguard 10 on the head and pulls the headguard 10 down on all sides so that the front of the headguard 10 sits directly above the brow on the forehead. Above each eye, the front vents 128*a* and 128*b* typically run perpendicular to a horizontal line in the middle of the forehead to points on either side of and just short of the crown of the head. The front panel 108 typically fits over the forehead and temple areas and continues to just above the ears. The lower parts of the two expansion joints 142 and 144 are typically positioned on either side of the head just in front of the ears. The rear panel 114 typically covers the occipital bone. By adjusting the tension of the head adjustment strap 102 and snapping the fastener 150, the headguard 10 may be drawn into and remain in a shape that conforms to the head. If the chin strap 104 is attached, the chin strap 104 can be adjusted so that it does not chafe the neck or the underside of the chin but will prevent the headguard 10 from being displaced from the head during play.

Figure 8:
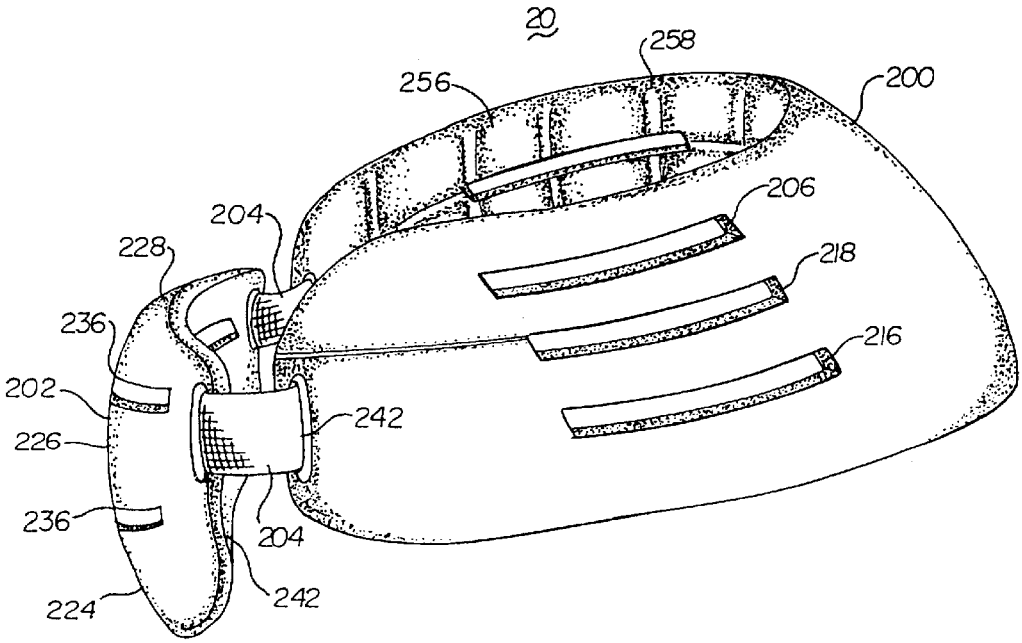
FIG. 8 is a perspective view of an exemplary headguard in accordance with another embodiment of the invention.
Figure 9:
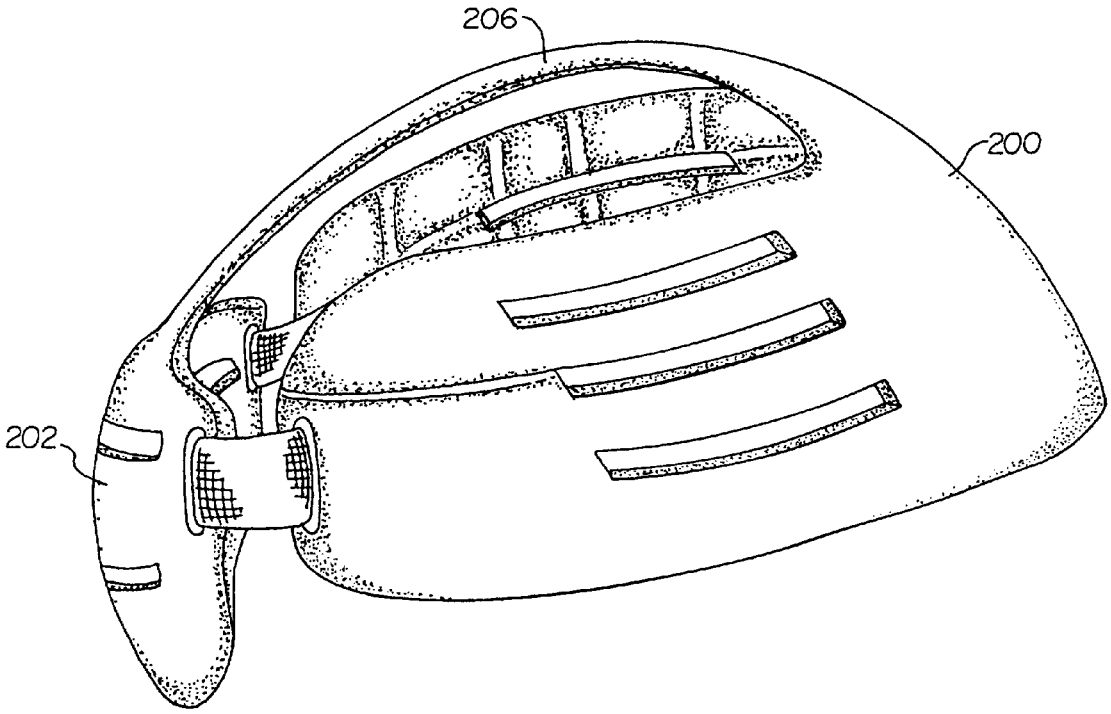
FIG. 9 is a perspective view of an exemplary headguard in accordance with another embodiment of the invention.

FIG. 8 illustrates an exemplary headguard in accordance with another embodiment of the invention. The headguard 20 includes of a front panel 200, a rear panel 202, and two adjustable side fasteners 204 made of elastic or other stretchable material, for example. An optional spine 206 may be provided as illustrated in FIG. 9. The panels 200 and 202 are typically made of a shock-absorbing material such as foam or padding which dissipates the force to the wearer's head when struck by an object and which is positioned on the headguard 20 to protect the regions of the wearer's head which may strike objects during the course of play. In this example, the panels 200 and 202 cover predominantly the front, part of the sides, and back parts of a wearer's head. If the spine 206 is added, part of the crown of the head may be covered. This positioning of the padding is particularly suited for soccer players, who often use these areas of the head when striking a soccer ball.

The padding in the panels 200 and 202 is typically sufficiently flexible so as to conform to unique head shapes and sizes. The position of the panel padding may be suitably selected in consideration of the particular environment in which the headguard 10 is worn. For example, when used during the play of soccer, the padding may be positioned to provide a relatively uniform exterior surface over portions of a player's head which generally come in contact with a soccer ball, thus allowing greater control of the ball.

The thickness of the padding may be suitably selected in consideration of the portion of the head which the padding is to cover as well as in consideration of the particular environment in which the headguard is worn. For example, the thickness of the padding may vary among the top, front, side, and back portions of the padding. Pad thickness around, for example, ⅜ to ⅝ inches, would be suitable for many applications.

The padding may further include apertures, such as channels, holes, or similar features, to circulate air through and ventilate moisture from the headguard. Suitable padding material includes solid and/or laminated foam, formed from plastic, for example.

In the exemplary embodiment, the front panel 200 covers generally the forehead and at least a portion the temples; the rear panel 202 generally covers the back of the head near the occipital bone; and the spine 206, if included, attaches to the top of the front panel 200, runs over the crown to the back of the head, just above the occipital bone, and attaches to the rear panel 202.

Figure 10:
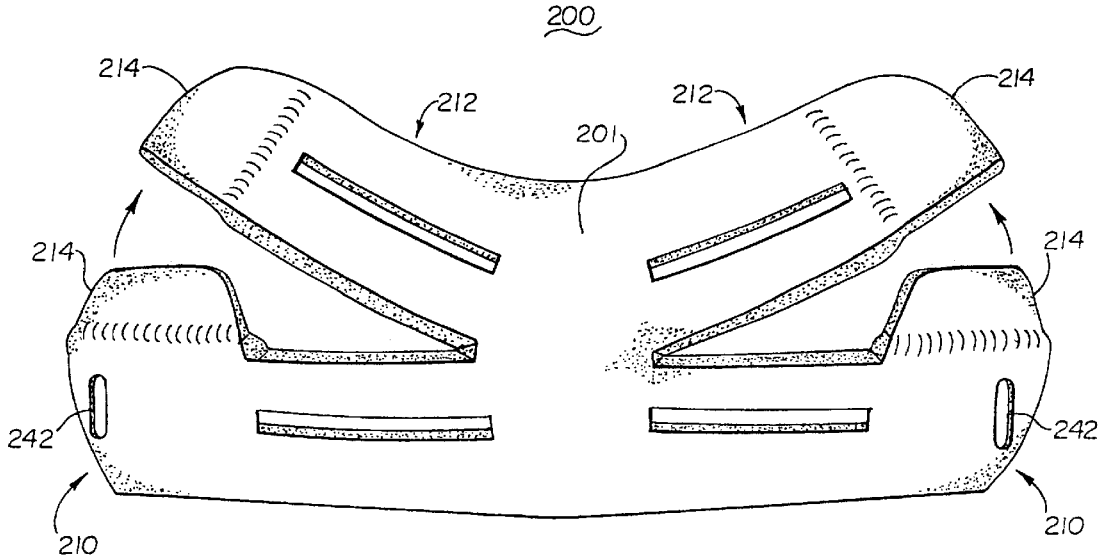
FIG. 10 shows an exemplary front panel of the headguard of FIG. 8.
Figure 12:
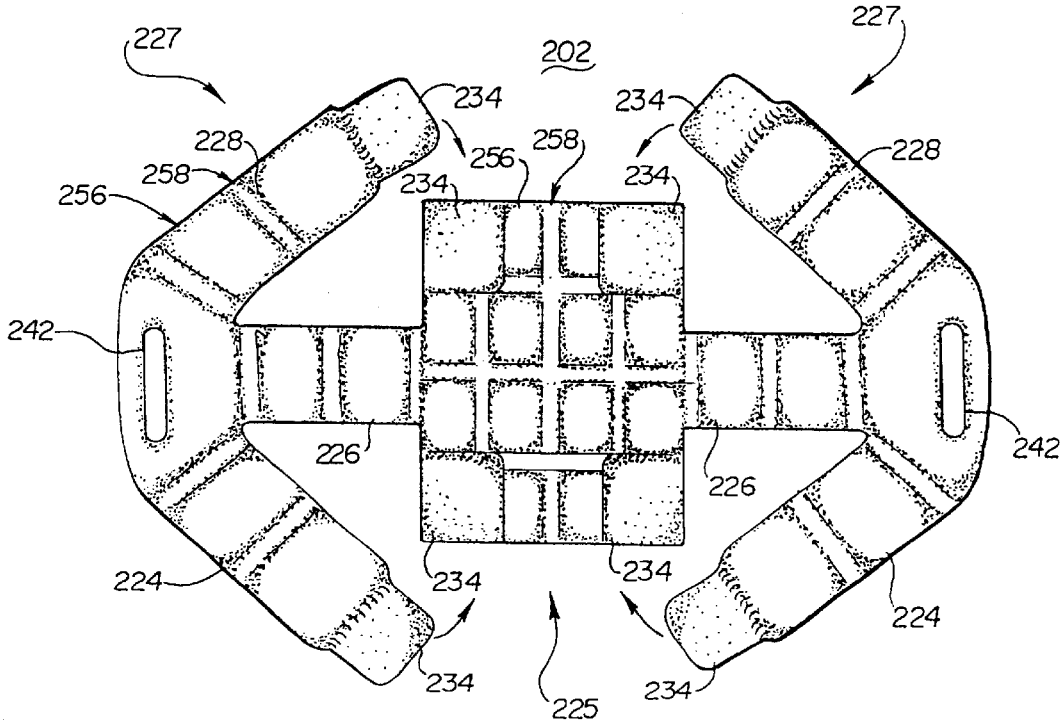
FIG. 12 is an interior view of the rear panel pad of FIG. 8 shown unassembled.
Figure 13:
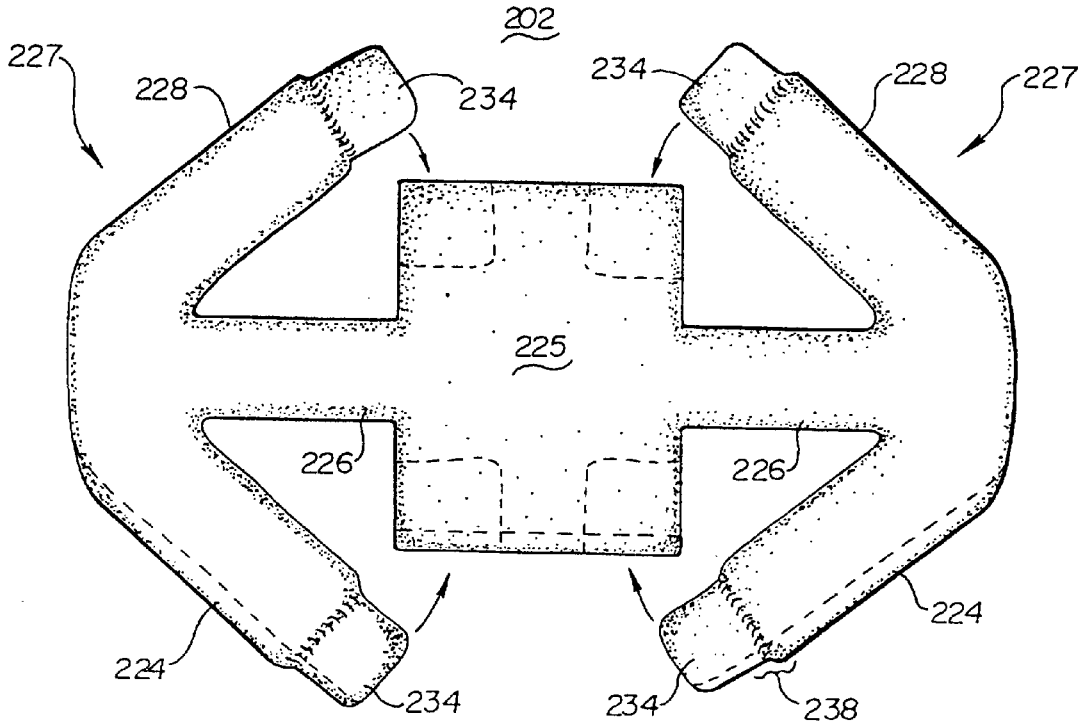
FIG. 13 is an exterior view of the rear panel of FIG. 12.

As illustrated in FIGS. 10, 12 and 13, the panels 200 and 202 are each typically molded as generally flat pieces. In assembly, parts of each panel 202, 204 are fastened together to create the cupped front and rear panels 200 and 202, shown in FIG. 8, that conform to that portion of the head which they cover. The fastening typically occurs at zero areas which are areas of thinner foam. Because the zero areas are thinner than adjacent padding, the overall thickness of the headguard 10 can remain generally uniform even when the zero areas are attached in an overlapping position.

The panels 200 and 202 may have fabric laminated to the exterior surface and interior surface. The exterior fabric typically is durable and provides a surface that allows good control of the ball when heading the ball but is not so tactile that the headguard will grip objects, including the soccer ball, or extremities of other players.

Turning back to FIG. 10, the front panel 200 typically includes a center pad 201 and a lower rib 210 and upper rib 212 extending from respective sides of the center pad 201. On each side the lower and upper ribs 210 and 212 are bent and fastened by stitching or other fastening mechanisms to each other. The fastening occurs at the zero areas 214 of the lower and upper ribs 210 and 212. To connect the two zero areas 214 of the lower and upper ribs 210 and 212, the ribs are typically twisted and bent, causing the front panel 200 to change from a relative flat panel to a cupped shape. When the zero areas 214 of the lower and upper ribs 210 and 212 are fastened together, the front panel 200 maintains the cupped shape to better conform to the shape of the forehead and sides of the head.

With reference to FIG. 10, open areas or vents 216 and 218 where padding does not cover the head provide ventilation and increase the plasticity of the padding. These open areas 216 and 218 are created in two ways. First, front vents 216 are molded into the lower and upper ribs 210 and 212. In addition, front vents 218 are created by the seams between the lower and upper ribs 210 and 212 when connected.

Figure 11:
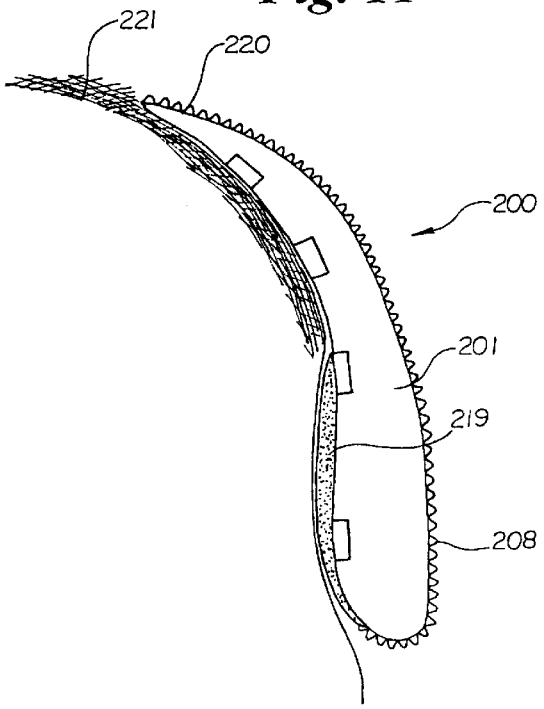
FIG. 11 is a cross-sectional view of the front panel of FIG. 8.

Turning now to FIG. 11, the front panel 200 may have a ridge 219 on the interior-side of the center pad 201. When the headguard 10 is worn, this ridge 219 may be positioned just below the frontal bone to inhibit unintended slippage of the headguard 10 from its intended position. In addition, this ridge 219 may be covered with a non-slip material such as suede to further prevent slippage. The top edge 220 of the front panel 200 (and/or the edge 222 of the spine 206 if it is included) may also be tapered to graduate the rise from the exterior surface of the top 221 of the head to the exterior surface of the top edge 220 of the front panel 200.

The rear panel 202 and assembly thereof will be discussed with reference to FIGS. 12 and 13. The rear panel 202 is assembled in a fashion similar to the assembly for the front panel 200. In this embodiment the rear panel 202 includes a central pad 225 and a flange 227 extending from each side of the center pad 225. Each flange 227 includes a middle rib 226 extending outward from a respective side of the center pad 225 and having a first end away from the respective side, an upper rib 228 interconnected between the first end and an upper portion of the respective central pad side, and a lower rib 224 interconnected between the first end and a lower portion of the respective central pad side. Zero areas 234 of the lower and upper rear ribs 224 and 228 are fastened to zero areas 234 on the four comers of the center portion 225 of the rear panel 202 in the same way that the zero areas discussed above with respect to the lower and upper ribs 210 and 212 of the front panel 200 are attached.

The zero areas of the front and rear panels 200 and 202 may be fastened by means of an adjustable fastener such as Velcro™, for example. If this is done, the size and shape of the headguard 20 may be further adjusted by the wearers to fit the unique sizes and shapes of different heads. In addition part of the assembly may be left to the wearer and shipping may be made easier.

The lower and upper rear ribs 224 and 228 may be molded at an angle to the middle ribs 226. When the angled lower rib 224, for example, is drawn closer to the middle rear rib 226 during assembly, the central pad 225 and ribs bulge and increases the cupping of the rear panel 202 to conform better with the shape of the occipital bone. In addition, cupping of the rear panel 202 can be increased by making the lower and upper rear ribs 224 and 228 shorter than the middle rear ribs 226. This draws the upper and lower portion of the rear panel 202 inward and bulges the central pad 225 that covers the occipital bone outward.

The gaps between the rear ribs 224, 226, and 228 on each side form the rear vents 236 (shown in FIG. 8) can allow the foam to bend into the rounded shape that conforms to the back of the head without stressing the foam or causing bulging of the foam in unintended spot, and which can increase ventilation.

The lower rear ribs 224 may be molded to have a wider width than the upper rear ribs 228. This extra width permits different sized headguards to be made without creating more than one mold. For larger headguards to fit larger heads, the full width of the lower rear ribs 224 may be left intact. For smaller headguards to fit smaller heads, the width of the lower rear ribs 224 may be reduced by cutting or other means in the assembly process.

The rear panel 202 is intended to protect the head from minor blows to the back of the head. Since the back of the head can be vulnerable to injury, this part of the headguard may be relatively thick as compared to the padding of the front panel 204, for example.

Returning to FIG. 8, two side fasteners or straps 204 made of elastic or other stretchable material connect the front and rear panels 200 and 202. In one embodiment the side fasteners 204 are positioned so that they are located slightly above and behind the ears on each side of the head. The side fasteners 204 may be attached to each panel 200, 202 through slits 242 molded in the rear edge of the front panel 200 and the side edges of the rear panel 202. Each side fastener 204, once passed through each slit 242, may be sewn or otherwise attached to itself to retain the side fastener 204 firmly to the front and rear panels 200 and 202. To increase the adjustability of the side fasteners 204, a sizing mechanism may be added to each side or one side to permit changes in the length of the elastic.

The front and rear panels 200 and 202 may be slightly offset with the lower edge of the rear panel 202 being lower than the lower edge of the front panel 200. This offset of the rear panel 202 directs the primary line of tension created by the elasticity of the side fasteners from a point just below the occipital bone on the rear of the head to the depression in the forehead just above the brow and below the frontal bone.

Mild tension created by the elasticity of the side fasteners 204 and the give in the panels as they rest on the head of the wearer typically keeps the headguard 10 in place. Only mild tension is typically necessary because the line of tension follows the circumference of the head from a point just below the occipital bone on the rear of the head to the depression in the forehead just above the brow and below the frontal bone. This circumference is typically less than the circumference of the head from the top of the occipital bone to the top of the frontal bone. Therefore the line of tension is usually located in a depressed area which would reduce slippage over the top of the head.

Reduced tension is desirable because it tends to reduce fatigue associated with a headguard that fits too tightly. If a slide mechanism is added to the side fasteners 204 to further increase adjustability, the headguard 20 can further expand or contract and thereby permit the wearer to increase or decrease the size of the headguard to fit the unique characteristics of the wearer's head.

Figure 15:
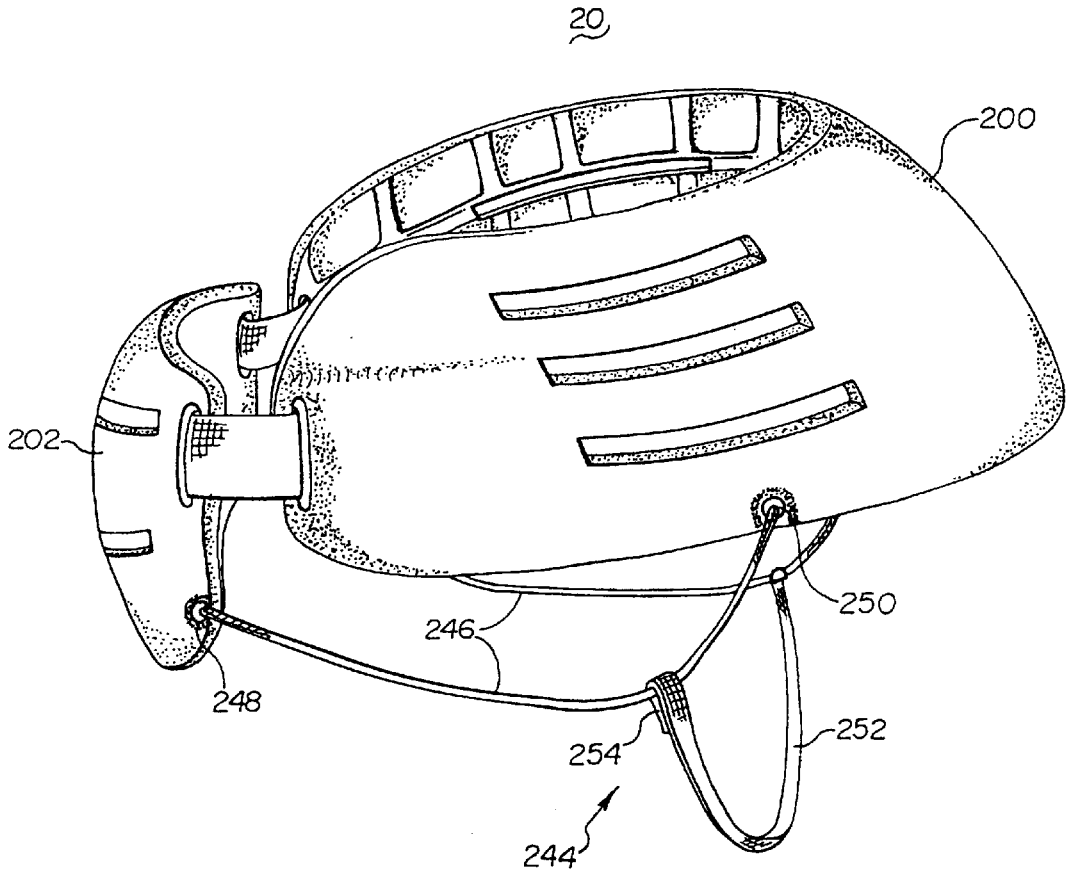
FIG. 15 is a perspective view of the headguard of FIG. 8 with a chin strap.

In a further embodiment, a chin strap 244 may be attached to the headguard 20, as illustrated in FIG. 15, to better retain the headguard 20 on the head during play. The chin strap 244 may be attached to the headguard 20 at up to four places. For example the chin strap 244 may be a three strap system which includes two cords 246 running from a rear slot 248 on each front edge of the rear panel 202 to a front slot 250 on each side of the front panel 200. Attached to the cords 246 may a slide strap 252. The slide strap 252 may fasten to the cords 246 with Velcro™ or other fastener. For example, the ends of the strap 252 may include either a hook or loop material and inner parts of the strap 252 may include the mating material. The strap ends may be looped around the straps 246 and interconnected to the inner parts using the hook and loop material. The slide strap 252 may be placed on the cords 246 at a position that is comfortable to the wearer and may, for example, be attached at that point with the fastener 254 on both sides of the head. The fastener 254 typically releases if sufficient pressure is applied in order to prevent injury.

Referring back to FIG. 9, the optional spine 206 may also connect the front and rear panels 200 and 202. The spine 206 is typically created along with the front and rear panels 200 and 202 during the molding process in the form of a single flat pad. After assembly, the spine 206 runs from the top of the front panel 200 over the crown of the head to the top of the rear panel 202. The assembly may be carried out in the same fashion as with the headguard 20 of FIG. 8. The spine 206 can provide additional protection to the head and may assist in preventing slippage of the headguard over the brow or down the neck.

In an alternate embodiment, the headguards of FIGS. 8 or 9 may be molded into their final shape through a process such as injection molding. In this manner, assembly, such as stitching zero areas, may be eliminated and the headguard may be molded to a cupped shape that conforms to the head.

The interior of the headguard 20 which comes in contact with the head may include pillows 256, as illustrated in FIGS. 8 and 12. The pillows 256 are raised portions of the foam separated by channels 258. The pillows 256 may be formed in a similar manner as and have the same general characteristics as the pillows discussed above.

Figure 14:
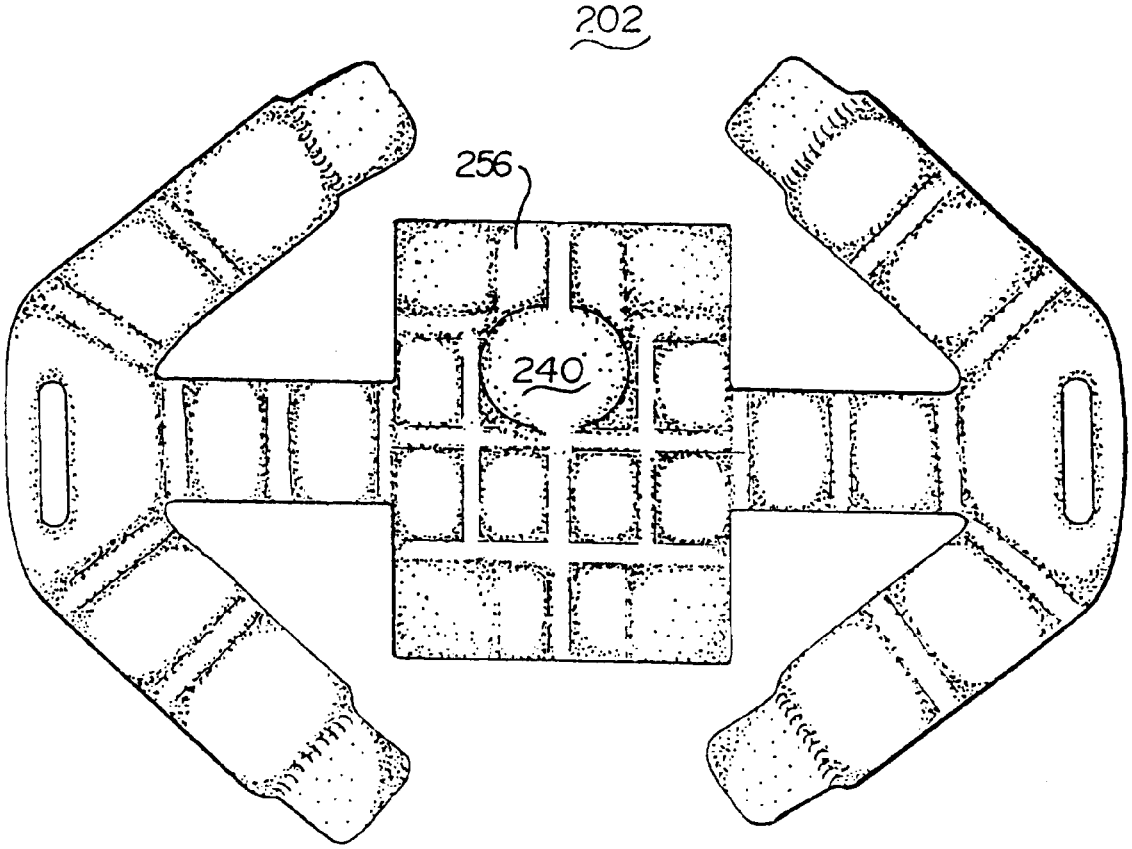
FIG. 14 is an interior view of another rear panel which may be used with the headguard of FIG. 8.

In one embodiment shown in FIG. 14, the pillows 256 of the rear panel 202 define a circular or semi-circular depression 240 on the interior-side of the rear panel 202 in the area for covering the occipital bone. The purpose of this depression 240 is to improve retention of the headguard on the head and to disperse energy from a blow to the back of the head away from the top of the occipital bone and to the upper neck and a larger area of the head.

In use, a wearer typically slips the headguard 20 on the head and pulls the headguard 20 down on all sides so that the front panel 200 sits directly above the brow on the forehead. The front vents 216 typically run horizontally on either side of the midpoint of the forehead to a height short of the crown of the head. The front panel 200 typically fits over the forehead and part of the temple areas and continues to just above the ears. The rear panel 202 typically covers the occipital bone and part of the area around it. The side fasteners 204 stretch as the wearer dons the headguard 20 to fit the head of the wearer. If an additional adjustable slide is added to the side fasteners 204, adjustment can be further enhanced. If the chin strap 244 is attached, the chin strap 244 can be adjusted so that it does not chafe the neck or the underside of the chin but will prevent the headguard 20 from being unintentionally displaced from the head during play.

Figure 16:
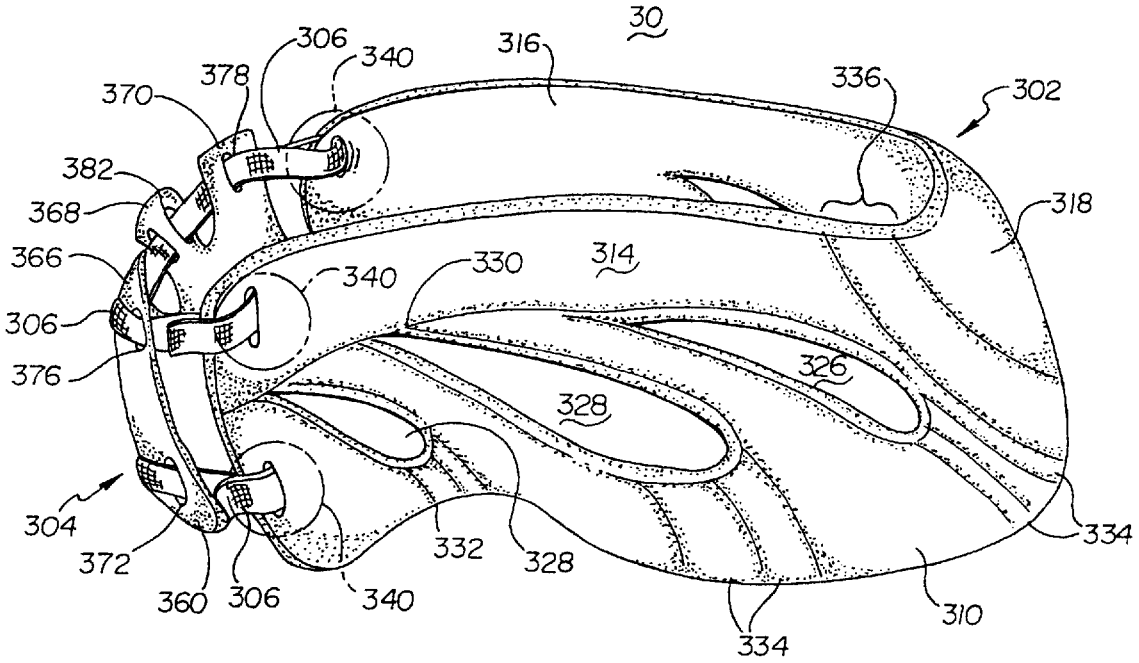
FIG. 16 is a perspective view of an exemplary headguard in accordance with another embodiment of the invention.
Figure 17:
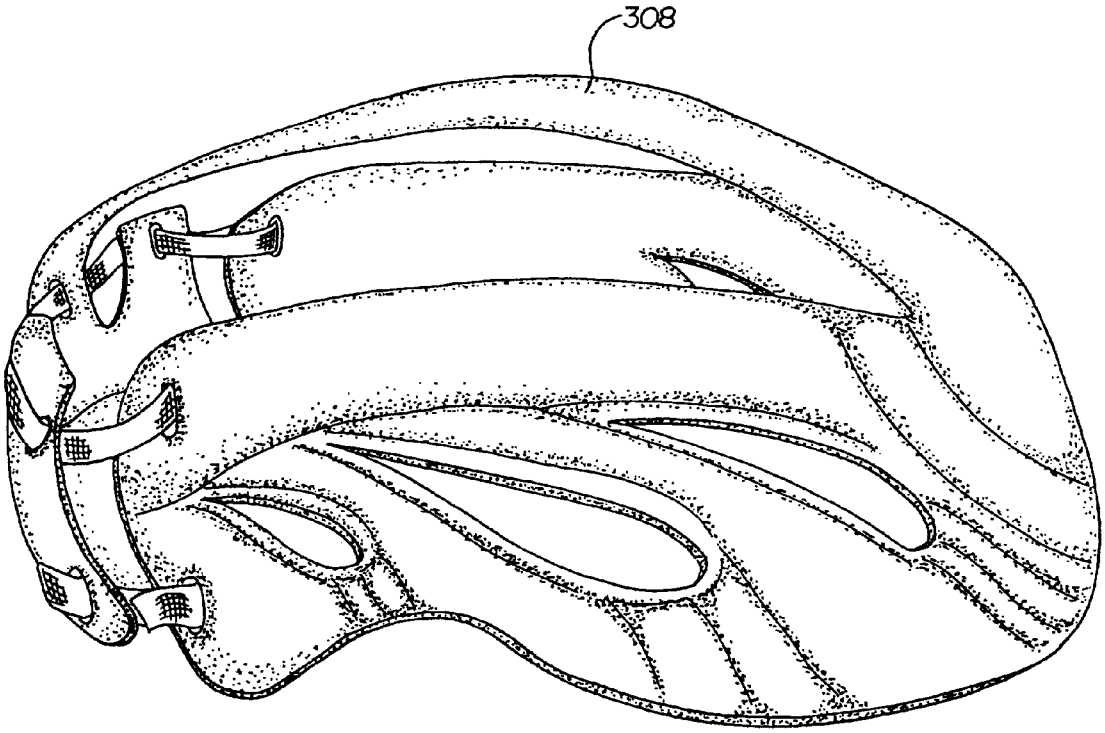
FIG. 17 is a perspective view of an exemplary headguard in accordance with another embodiment of the invention.

FIG. 16 illustrates further exemplary headguard in accordance with another embodiment of the invention. The headguard 30 typically includes a front panel 302, a rear panel 304, and adjustment strap system, for example, two or more adjustment straps 306 made of elastic or other stretchable material. An optional spine 308 may be provided as illustrated in FIG. 17.

The panels 302 and 304 are typically made of a shock-absorbing material such as foam which dissipates the force to the wearer's head when struck by an object such as a ball. The foam or padding of the headguard 30 is intended to protect the regions of the wearer's head which may strike objects during the course of play. The foam may have fabric laminated to it on the interior and/or exterior surfaces. In this embodiment, the panels 302 and 304 cover predominantly the forehead, the sides from just below the crown and down to the upper part of the temples, and the back of the wearer's head around the occipital bone. If a spine is added, part of the crown of the head may be covered. This positioning of the padding and the location of open areas in the foam is particularly suited for soccer players, who often use these areas of the head when striking a soccer ball.

The padding in the panels is typically sufficiently flexible so as to conform to unique head shapes and sizes. The position of the padding may be suitably selected in consideration of the particular environment in which the headguard is worn. For example, when used during the play of soccer, the padding may be positioned to provide a relatively uniform exterior surface over portions of a player's head which generally come in contact with a soccer ball, thus allowing greater control of the ball.

The thickness of the padding may be suitably selected in consideration of the portion of the head which the padding is to cover as well as in consideration of the particular environment in which the headguard 30 is worn. For example, the thickness of the padding may vary among the top, front, side, and back portions of the padding. Pad thickness around, for example, ½ to ⅝ inches, would be suitable for many applications. Suitable padding material includes solid and/or laminated foam, foam formed from plastic, for example, and foam laminated with fabric on the interior or exterior surfaces.

Figure 18:
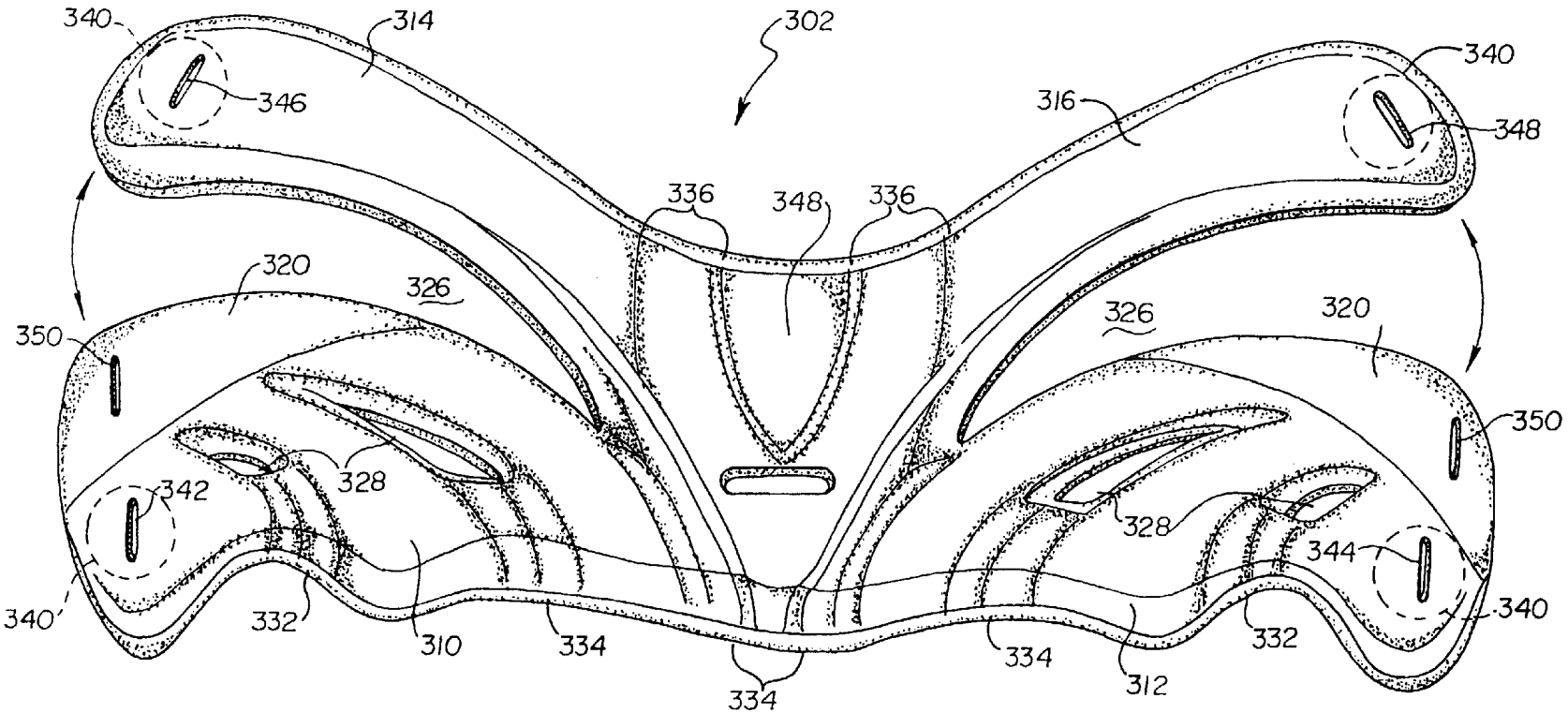
FIG. 18 is an exterior view of an unassembled front panel of the headguard of FIG. 16.

As illustrated in FIG. 18, the front panel 302 is typically made from a flat piece of foam molded or cut into the proper shape which also can have fabric laminated to either or both sides. Referring now to FIGS. 16 and 18, the front panel 302 has two lower ribs 310, 312 and two upper ribs 314, 316 emanating from respective sides of a center front pad 318 which typically covers at least part of a wearer's forehead.

On a portion of the exterior surface of each lower rib 310, 312 is a thinner area or zero area 320. For the zero areas 320 a thickness for the padding of approximately ⅛ inch would be suitable. The interior surface of each upper rib 314, 316 may have a receiving depression 322 (shown in FIG. 19) which typically corresponds to the size and shape of the zero areas 322 on the lower ribs 310, 312. The depth of the receiving depressions 322 typically is about equal to the thickness of the zero areas 320 on the lower ribs 310, 312.

In assembly, the upper and lower ribs 310–316 are bent so that the zero areas 320 of the lower ribs 310, 312 align with the receiving depressions 322 of the upper ribs 314, 318. The left lower and upper ribs 312, 316 attach to each other, and the right lower and upper ribs 310, 314 attach to each other. By bending the ribs 310–316 in this fashion, the center front pad 318 is typically pushed outward, and the front panel 302 takes on a cupped shape that more closely conforms to the shape of the human head. The thickness of the padding at points where the zero areas 320 and the receiving depressions 322 overlap is typically about equal to the thickness of the padding thicker portions of front panel 302.

In order to maintain the cupped shape of the front panel 302, the upper and lower ribs 310–316 on each side may be permanently attached to each other at the overlap of the zero areas 320 and receiving depressions 322 by stitching, or they may be attached by hook and loop fasteners. The hook and loop fasteners may be located on the zero areas 320 and receiving depressions 322 for disposal between these structures. Use of hook and loop fasteners permits easy disassembly of the front panel 302.

When assembled, the front panel 302 typically defines three vents on either side of the center front pad 318. A aperture or seam vent 326 is created on each side between the upper and lower ribs 310–316 of each side when they are bent and attached. In addition two vents 328 are molded or cut into each of the lower ribs 310 and 312.

To aid in flexing the pads to conform to the head, channels may be molded into the exterior surface at different locations to create flexing areas 332, 334, 336. One or more channels may, for example, be disposed between each of the upper ribs 314, 315 and the central pad 318 for increasing flexing between these ribs and the central pad.

Figure 20:
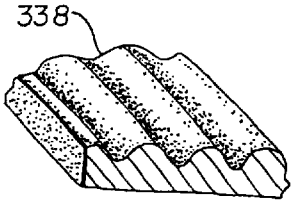
FIG. 20 is cross-sectional view of a portion of the headguard of FIG. 16.

A detailed view of an example flexing area 338 is shown in FIG. 20. The flexing areas 332, 334, 336 are located in several spots on the front panel 302. The flexing areas function as hinges by increasing the ability of the foam to flex and curve in order to conform to the shape of the head.

The padding is thinner at the base of the channels thus increasing the flexibility of the foam generally in the direction opposite the direction of the channels.

The channels allow the padding to bend along the channels. As noted above, a flexing area may consist of one or more channels. If there is more than one, the channels run generally parallel to each other (although non-parallel channels from different flexing areas may intersect). While flexing areas with one to four channels are disclosed, the invention extends to cover flexing areas with more channels.

The channels of the flexing areas 332, 334, 336 are molded into the exterior surface of the front panel 302 at points where the front panel 302 desirably curves most severely in order to conform to the shape of the head. For example, the flexing areas 334 are located at the portion of the front panel 302 which typically rests on the part of the head that forms the transition from the forehead to the side of the head. The channels of the flexing areas 332, 334 typically run at angles to the bottom or top edges of the assembled front panel between 45 and 90 degrees thereby increasing the ability of the front panel to wrap around the head. The channels in flexing areas 332, 334 may run approximately along the same line as and along side the vents 328 and 326 in the front panel 302 as shown. Another flexing area 336 may surround the frontal bone, which on some wearers protrudes outward.

As best shown in FIGS. 16 and 18, the front panel 302 includes four attachment points 340 which serve as locations where the adjustment straps 306 may be attached to the front panel 302. The attachment points 340 are typically areas where slots 342–348 are molded into the foam as shown best in FIG. 18. Alternatively, the attachment points 340 may be small depressed areas as shown in FIGS. 21A and 21B suitable for sewing attachment rings 352 and 354.

The attachment points 340 with slots 342–348 are shown in FIG. 16 in a fully assembled state and in FIG. 18 in the unassembled state. The slots 342–348 are openings molded or cut through the entire thickness of the padding through which the adjustment straps pass. The slots 342–348 may be of varying sizes but must be of a size to permit the adjustment strap 306 to pass through. A slot length of ⅝ to ¾ inches, for example, may be suitable.

To form the assembled front panel 302 of FIG. 16, the upper slots 346, 348 may overlap with slots 350 (shown in FIG. 18) located in the zero areas 320 of lower ribs 310 and 312 when the zero areas 320 and the receiving depressions 322 are bent together. When the upper and lower ribs 310–316 are joined together in assembly these slots 346, 348, 350 align to form one set of upper slots on each side of the front panel 302 as shown in FIG. 16.

Figure 21A:
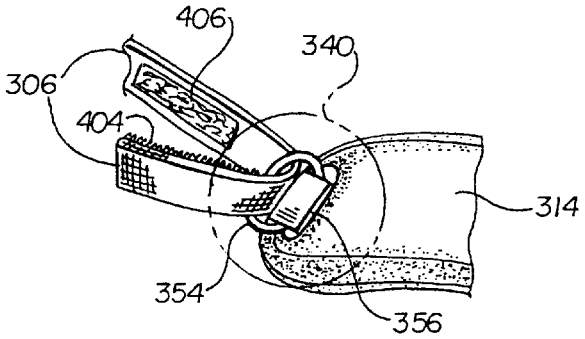
FIGS. 21A and 21B illustrate exemplary attachment mechanisms in accordance with an embodiment of the invention.
Figure 21B:
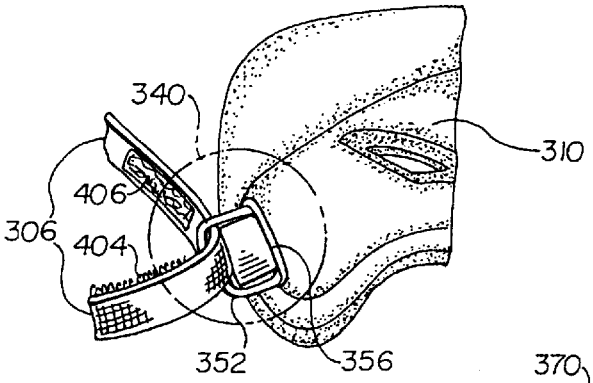
Figure 26:
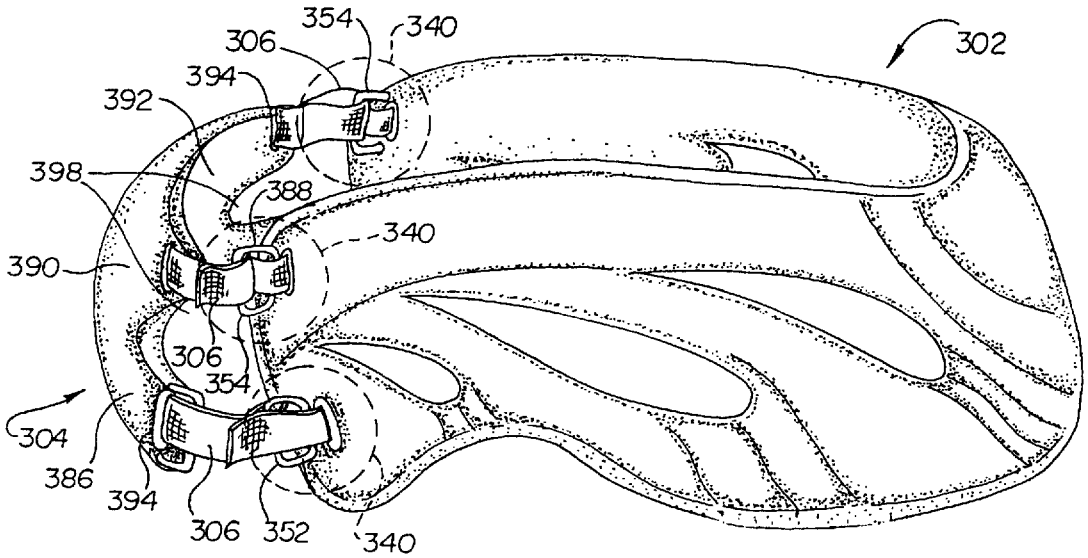
FIG. 26 is a perspective view of an exemplary headguard in accordance with another embodiment of the invention.

In the alternative embodiment, shown in FIGS. 21A–B and 26, the attachment points 340 are created by attaching, for example, attachment rings 352, 354 made of fabric, rubber, or other soft material, to the rear edges of the front panel 302. A depressed area can be molded into the rear edges at the attachment points 340. The rings 352, 354 may be attached by sewing the attachment rings 352, 354 to the ribs 310 and 314 with a piece of fabric 356. This same sewn seam may also permanently secure the upper and lower front ribs to each other.

Attachment of the adjustment straps 306 to the front panel 302 with rings can permit the adjustment straps 306, when attached to the attachment rings 352, 354 to slide up and down along the rings 352, 354. This can permit the rear panel 304 to be readily positioned at different heights in relation to the front panel 302 without binding of the adjustment straps 306.

Figure 22:
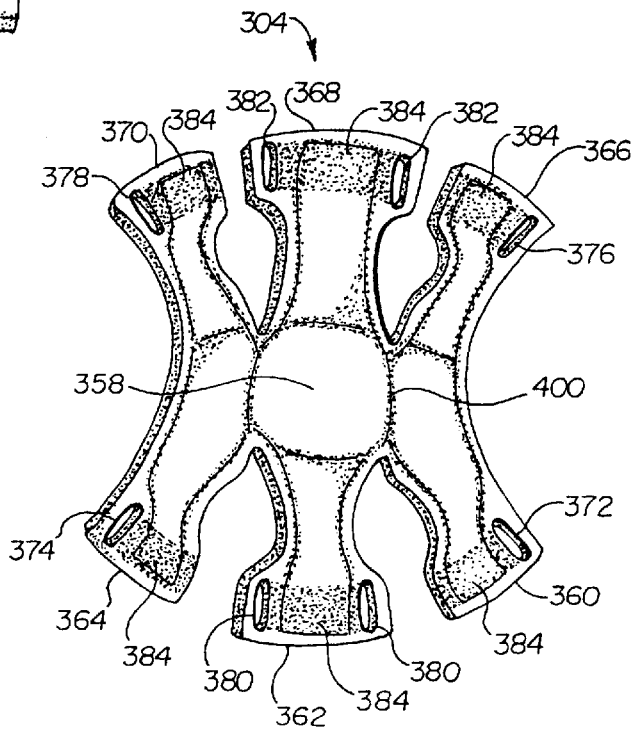
FIG. 22 is an exterior view of the rear panel of the headguard shown in FIG. 16.

Referring to FIG. 22, the rear panel 304 in the embodiment of FIG. 16, includes six rear ribs 360–370 integrally formed with a center pad 358 pad during the molding process. Three of the rear ribs 360–364 project downward from the center pad 358 and three ribs 366–370 project upward. Slots 372–382 are located near the ends of the ribs 360–370 away from the center rear pad 358. All slots 372–382 in this embodiment run generally parallel to the length of the ribs. All slots 372–382 in this embodiment for the rear panel 304 are also approximately the same size as the slots 342–348 for the front panel 302 described above.

Figure 23:
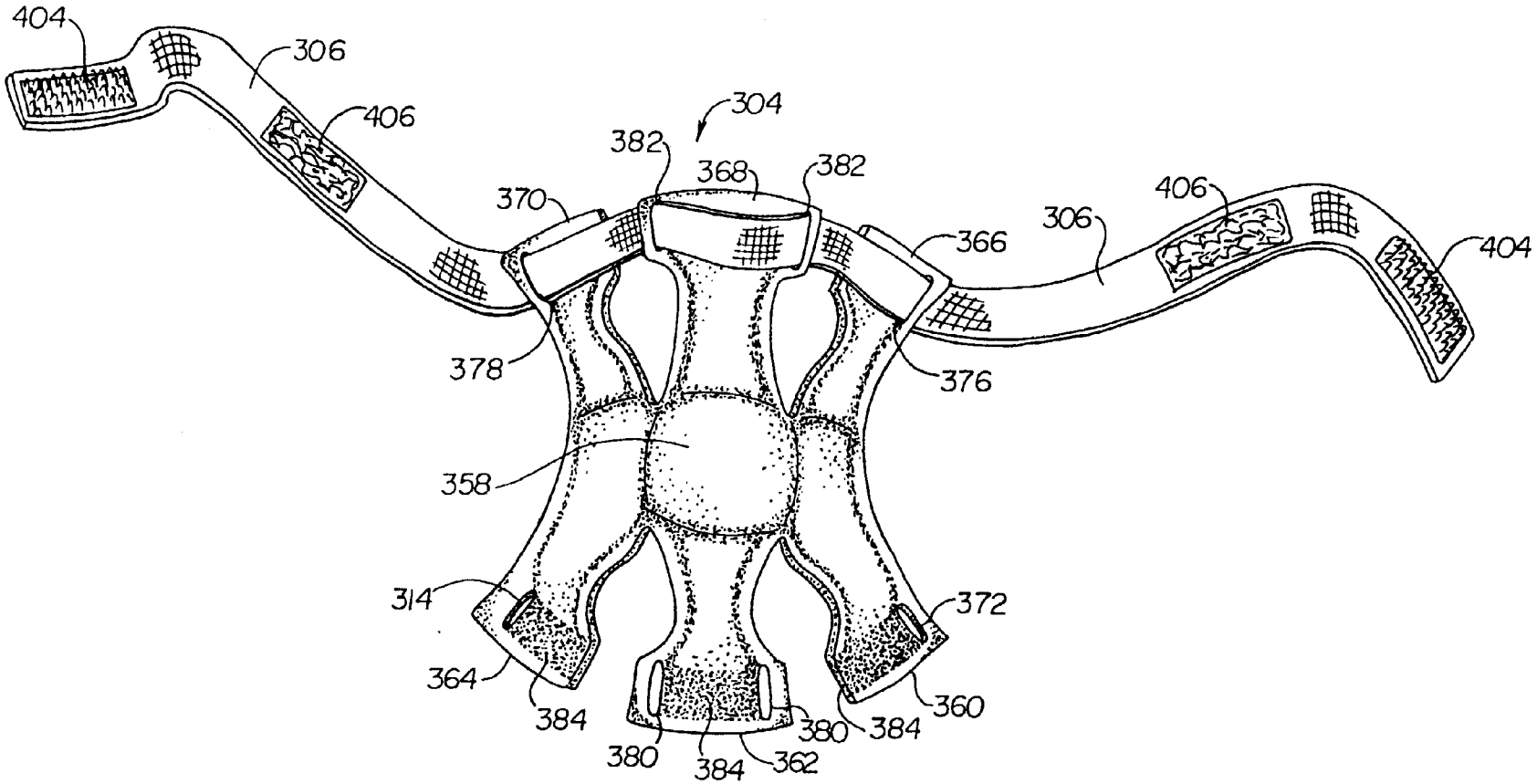
FIG. 23 is an exterior view of the rear panel of FIG. 22 shown with an adjustment strap.

At certain points slight depressions 384, in which the adjustment straps may lay, may be molded into the foam to guide the adjustment straps as they cross the rear ribs. These depressions 384 may be of the same depth as the thickness of the adjustment straps 306. An upper strap 306 shown interweaving through the ribs 366–370 of the rear panel 304 is depicted in FIG. 23. As shown in FIG. 16, the lower strap 306 may interweave through the rear panel 304 in the same manner.

Figure 24:
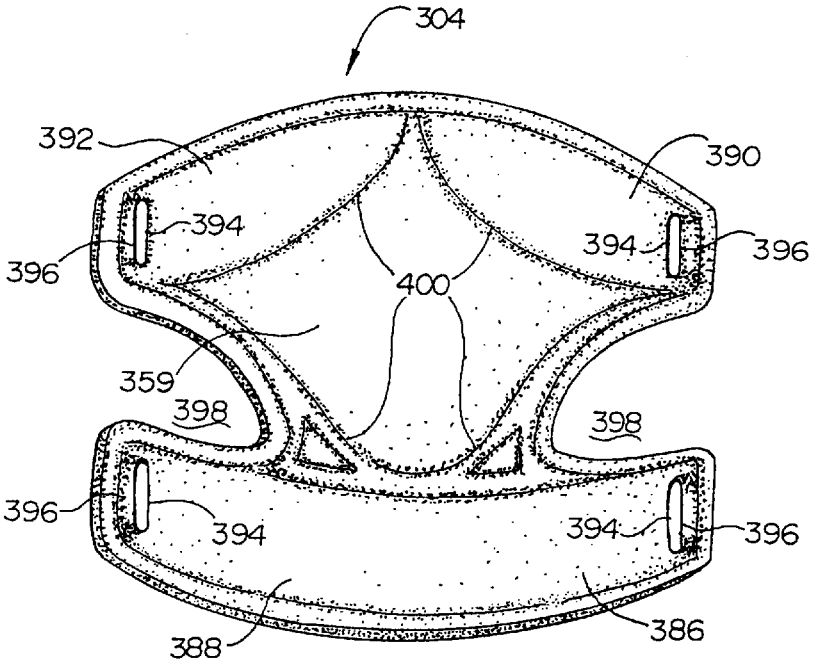
FIG. 24 is an exterior view of another rear panel in accordance with an embodiment of the invention.
Figure 25:
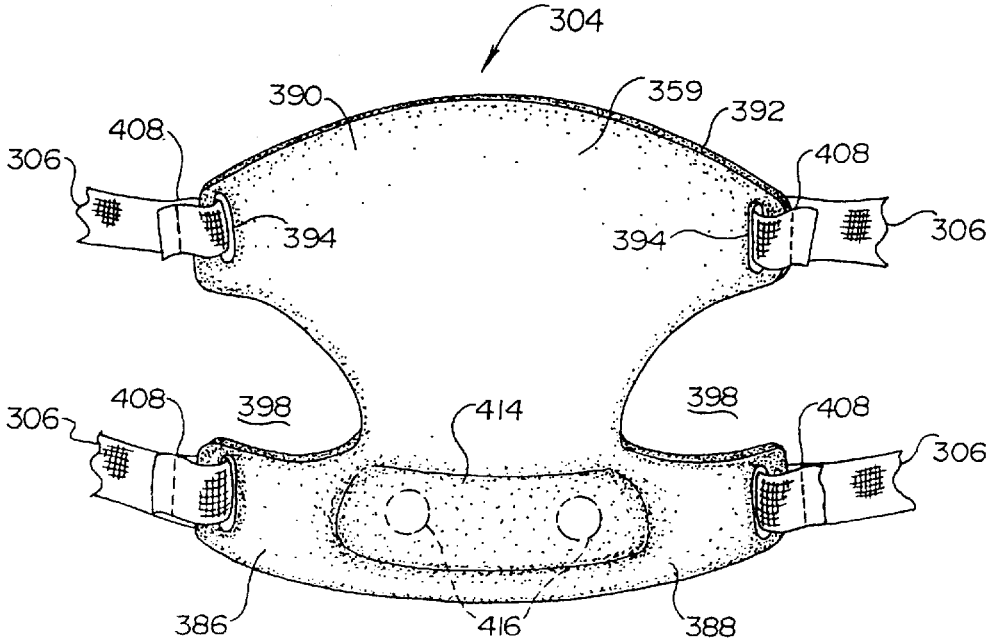
FIG. 25 is an interior view of the rear panel of FIG. 24.

In an alternative embodiment illustrated in FIG. 24, the rear panel 304 has four ribs 386–392 emanating from a center rear pad 359. Two of the rear ribs 388, 392 emanate generally horizontally to the left from one side of the center rear pad 359 and the other two 386, 390 emanate generally horizontally to the right direction from the other side of the center rear pad 359. At the end of each ribs 386–392 a ring may be attached similar to the rings 352, 354 attached to the rear edge of the front panel 302. Alternatively, slots 394 may be molded into the foam of the ribs 386–392 as shown in FIG. 24. The slots 394 are typically located near the end of the rear ribs away from the center rear pad 359. The slots 394 may be positioned at roughly a 90 degree angle to the length of the rib. The slots 394 may be of the same size as the ones described above. At certain points, the adjustment straps 306 cross the exterior or interior surface of the rear panel 304. At these locations, depressions 396 in which the adjustment straps 306 may be disposed, may be molded into the foam to guide the adjustment straps 306 over the exterior or interior surface of the rear panel 302. FIG. 25 shows the interior of this rear panel 304 with the adjustment straps 306 looped through the slots 394.

The space between the rear ribs of both embodiments form the rear vents 398 which can allow the foam to bend into the rounded shape that conforms to the back of the head without stressing the foam or causing bulging of the foam in unintended spots and can increase ventilation. Unlike the front vents 326, 328, the rear vents 398 are typically not filly enclosed by padding.

Similar to the front panel 302, either rear panel 304 embodiment may have flexing areas 400 integrated into the exterior surface. For example, flexing areas 400 may be formed from one or more channels molded into the padding in an area surrounding the occipital bone as is shown in FIGS. 22 and 24. This allows the rear panel 304 to bend more easily and better conform to the protrusion of the occipital bone on the back of the head of most wearers.

The rear panel 304 is intended to protect the head from minor blows to the back of the head. Since the back of the head can be vulnerable to injury, this part of the headguard may be relatively thick.

Figure 29:
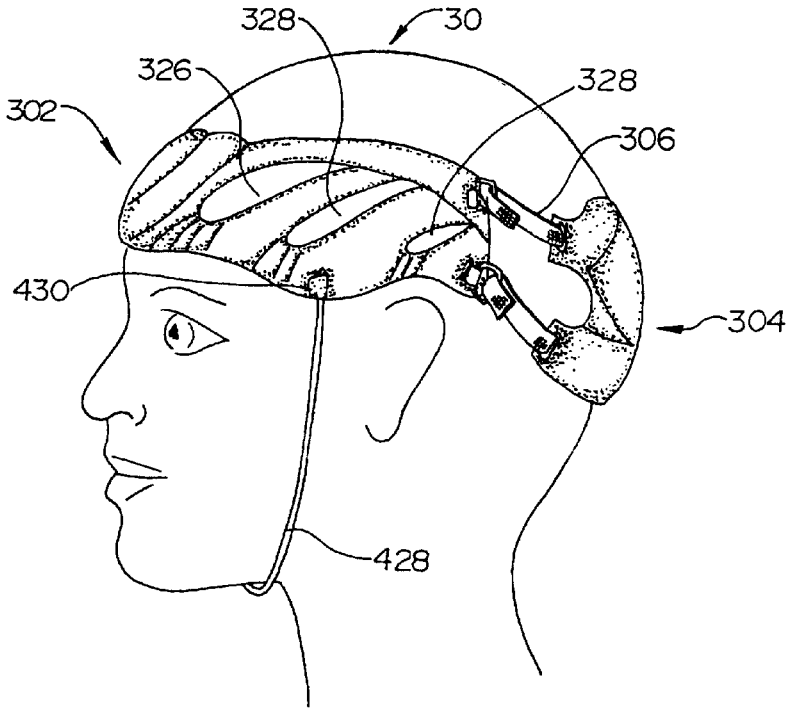
FIGS. 29 and 30 are side and rear views of an exemplary headguard as worn by a user.
Figure 30:
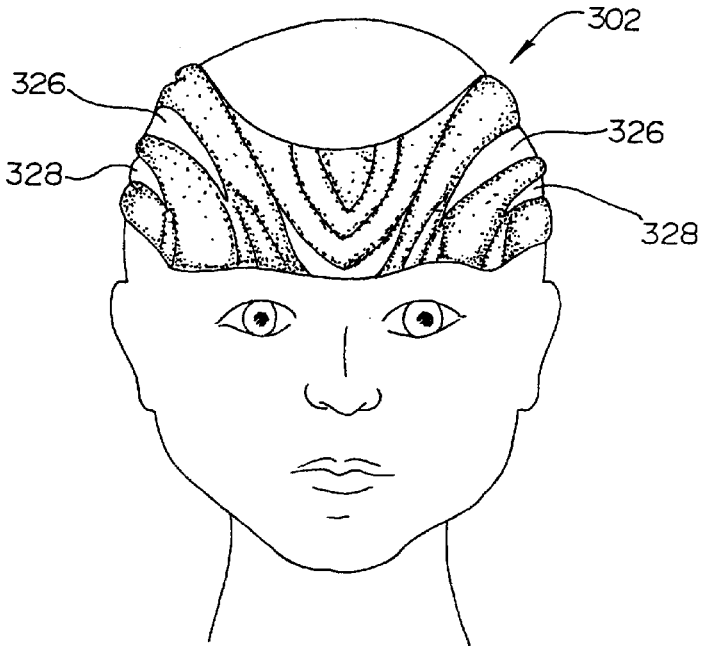

There are two to four adjustment straps 306 disclosed in this invention. The rear panel 304 with six rear ribs depicted in FIGS. 22 and 23 works optimally with two adjustment straps. The rear panel 304 with four rear ribs depicted in FIGS. 24 and 25 works optimally with four adjustment straps 306. The same front panel 302 may be used with any of the various embodiments of rear panels. FIGS. 29 and 30, for example, show the front panel 302 with a four rib rear panel 304.

The size and shape of and the materials for the adjustment straps 306 may vary. The adjustment straps 306 may be cylindrical, flat, or oblong. They may vary in width from approximately ⅛ to 1 inch. They may be made of material such as rubber, elastic, or any other stretchable material. The adjustment straps 306 disclosed are generally flat on two sides and between ⅜ to ½ inch in width. Use of adjustment straps 306 of a different size and shape would require alteration of the size and shape of the slots.

The two adjustment straps 306 are connected to the rear panel 304 with six ribs as follows and as shown in FIG. 23. Both adjustment straps 306 are threaded through the slots molded into the ends of the ribs of the rear panel in the same fashion. For example, the adjustment strap 306 for the upper ribs 366–370 is passed through the two slots 382 of the middle upper rear rib 368 from the exterior to the interior sides. The middle of the adjustment strap is typically positioned at the midpoint of the two slots 382 of the middle upper rear rib 368. The adjustment strap 306 is looped back out to pass through the upper right rear slot 376 and upper left 378 rear slot, again from the exterior to the interior side. Equal lengths of the adjustment strap typically extend from both the upper right and left rear ribs 366, 370.

Four adjustment straps 306 may be connected to the rear panel with four ribs 386–392 as shown FIG. 25. Each adjustment strap 306 is connected to each of the ribs 386–392 in the same way. For example, an adjustment strap 306 is drawn through the slot 394 of the upper left rear rib 392. (In the place of the slots 394, rings similar to the attachment rings 352, 354 described above may also be attached to the rear panel 304.) After being drawn through the slot 394, that end of the adjustment strap 306 is folded into a loop and attached permanently to itself by a sewn joint 408 or other attachment means as shown. In the same fashion, each of the remaining three adjustment straps is attached to the remaining three ribs.

Regardless which rear panel 304 embodiment is employed, once the adjustment straps 306 are attached to the rear panel 304 as described above, four ends of the adjustment straps 306 extend from the rear panel 304 and connect to the front panel 302. As illustrated in FIGS. 21A and 21B, to the ends of each upper and lower adjustment strap, a set of hook and loop fabric strips 404, 406 is attached. For example, a hook fabric strip 404 is attached to one of the flat sides of one of the adjustment straps. At a distance from the end of the adjustment strap, a strip of looped fabric 406 is attached to the same flat sides of the adjustment straps. The distance the strips of hook and loop fabric are located from each other is dependent of the size of the head the headguard is intended to protect. Each end of the adjustment strap is looped through the rings 352 and 354 (or alternatively slots). Each end of the four adjustment straps is attached to the front panel 302 in this way. By varying the point at which the hook and loop fabrics are joined, the straps may be independently adjusted and the fit of the headguard can be adjusted.

Other means of attaching the end of the adjustment straps 306 to the front panel may include slide fasteners instead of hook and loop fasteners. Slide fasteners may slide into place and then lock in position to maintain the fit desired by the wearer.

Figure 19:
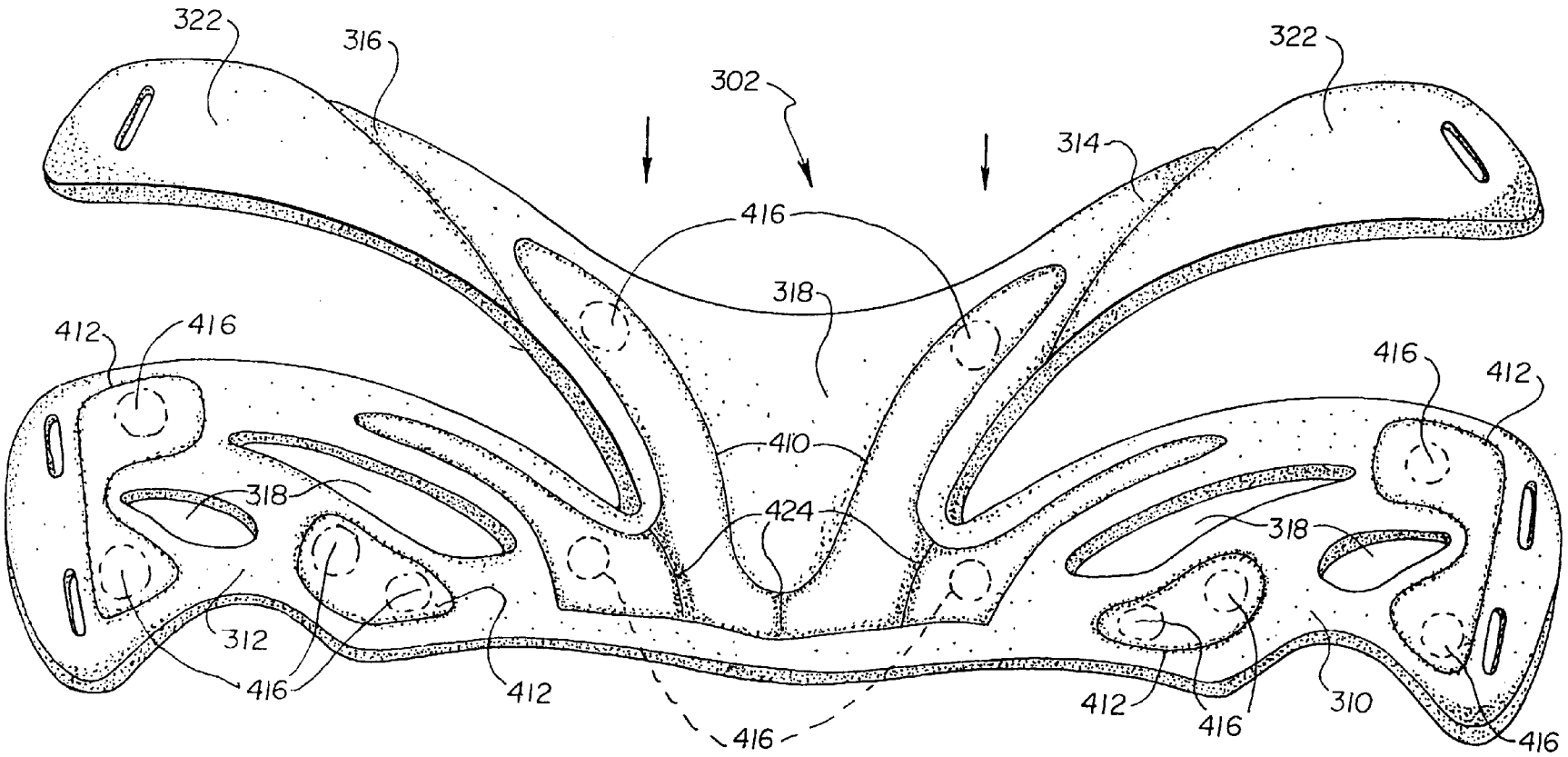
FIG. 19 is an interior view of the unassembled front panel of the headguard of FIG. 18.

Turning now to FIGS. 19 and 25, to expand sizing capabilities and to improve ventilation, sizing pads 410–414 may be attached to the interior of the headgear 30. These inserts may be attached to the interior surface with hook and loop fasteners. Sizing pads 410, 412 suitable for the interior of the front panel 302 are shown in FIG. 19 and a sizing pad 414 suitable for the rear panel is shown in FIG. 25. The sizing pads 410–414 serve several purposes. By raising the front or rear panel from the head, air space between the head and the panels of the headguard may be created to enhance ventilation. Second, the sizing pads enhance the ability of the headguard to be fitted to the size and shape of the wearer's head. This aids both in retaining the headguard on the wearer's head in achieving a more comfortable fit. Finally, the foam inserts may be easily removed and washed.

The sizing pads 410–414 may be made of different materials. Open-cell foam with cloth laminated to one or both sides would function well. The thickness of the sizing pads may vary. Thicknesses from ⅛ to ⅜ inch would be preferable. Multiple pads may be used for both the front and rear panels or a single pad for the front and a single pad for the rear panel may be employed. FIG. 19 shows an embodiment with multiple pads 410, 412 for the front panel 302 and FIG. 25 shows an embodiment with a single pad 414 for the rear panel 304. The sizing pad 414 on the rear panel 304 is intended to be located beneath the occipital bone thus forming a ridge which is intended to reduce the slippage of the rear panel 304 over the occipital bone when the headguard is worn. The sizing pad 414 may align with lower adjustment straps 306. Similarly, as shown in FIG. 19, the sizing pad 410 located at the center of the interior side of the front panel 302 may form a ridge to prevent slippage of the front panel 302 over the frontal bone when the headguard is worn.

Figure 27:
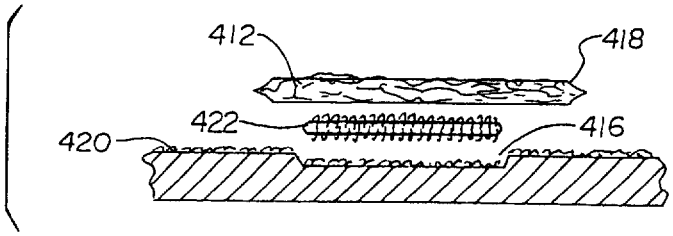
FIGS. 27 and 28 illustrates the attachment of sizing pads in accordance with further embodiments of the invention.
Figure 28:
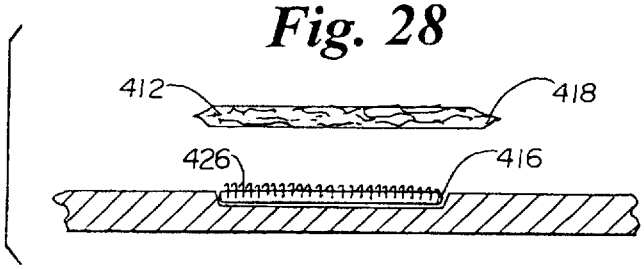

Turning now to FIGS. 27 and 28 attachment of the sizing pads will be discussed. The sizing pads 410–414 may be attached to the interior of the headguard using hook and loop fasteners. A slight depression 416 of approximately ⅛ inch or less in depth is typically molded or cut into the interior side of a panel at the point where the hook and loop fasteners for a sizing pad are to be positioned. The depressions 416 for the hook and loop fasteners are identified by the circular dashed lines in FIGS. 19 and 25.

Two methods of attaching the sizing pads are disclosed here and illustrated in FIGS. 27 and 28. In FIG. 27, the fabric 418 laminated to the sizing pads and the fabric 420 laminated to the interior of the panels may be loop fabric as shown. Circular strips of fabric 422 with loops on both sides may be placed in the circular depressions 416 intended for them. The hooks of the circular strips of fabric 422 attach to the fabric 420 laminated to the interior side of the panel. The sizing pad 412 is placed in proper position and the loop fabric 418 of the sizing pad attaches to the exposed loops of the circular strips as shown in FIG. 27. To enhance the ability of the sizing pads to conform to the head, channels 424, as shown in FIG. 19, may be permanently pressed into the sizing pads at those locations where the sizing pads bend to conform to the curves of the head.

A second method of attaching sizing pads is shown in FIG. 28. The key difference in this second method of attachment is that the hook fastener 426 is single-sided and the side faces toward the interior side which attaches to the sizing pad. The other side is attached to the interior side of the panels by adhesive other means.

The chin straps disclosed in earlier embodiments may also be employed with the headguard 30. Alternatively, a chin strap 428 of stretchable material, for example, elastic or rubber cord, may be provided as shown in FIG. 29. The two ends of the chin strap 428 may be attached to the front panel 302 of the headguard 30 at two points on the front panel 302 located in a downwardly extending portion or protrusion 430 for covering a temple. Hook and loop fasteners on the end of each cord and on the protrusion 430 may be used to secure the chin strap 428 and ensure that the chin strap 428 detaches from the headguard 30 if sufficient force is applied. The chin strap 428 may release if sufficient pressure is applied in order to prevent injury.

The optional spine 308 runs from the top middle portion of the front panel to the top portion of the rear panel as shown in FIG. 19. The spine 308 may be of any width depending on the amount of the top part of a head desired to be covered.

In alternative embodiments, front panel 300 may be molded in the shape shown in FIG. 16, for example, through a process such as injection molding. This allows the front panel 300 to be formed in a cupped shaped with requiring stitching or otherwise fastening ribs. The rear panel 302 may also be injection molded if desired. The adjustments straps may attach to the front and rear panels in the same fashion as described above.

In use, a wearer typically slips the headguard 30 on the head and pulls the headguard down on all sides so that the front panel should preferably sit directly above the brow on the forehead. A headguard fitted on the head of a wearer is shown in FIGS. 29 and 30. As illustrated in FIGS. 29 and 30, above each eye, the seam vents run at between 20 to 90 degree angles toward the crown of the head. The other vents 328 run approximately parallel to the seam vents 326. The front panel 302 fits over the forehead and part of the temple areas and continues to just above the ears. The rear panel 304 covers the occipital bone and part of the area around it. The adjustment straps 306 stretch as the wearer dons the headguard to fit the head of the wearer. The fit of the headguard can be changed by adjusting the adjustment straps 306. If the chin strap 428 is attached, the chin strap 428 can be adjusted so that it does not chafe the neck or the underside of the chin but will prevent the headguard from being unintentionally displaced from the head during play.

Mild tension created by the elasticity of the adjustment straps 306 and the flexibility in the panels 300 and 302 as they rest on the head of the wearer should be sufficient to keep the headguard in place. Reduced tension is preferred because it will reduce fatigue associated with a headguard that fits too tightly. Only mild tension is typically necessary because the line of tension follows the circumference of the head from a point just below the occipital bone on the rear of the head to the depression in the forehead just above the brow and below the frontal bone. This circumference should be less than the circumference of the head from the top of the occipital bone to the top of the frontal bone. Therefore the line of tension would be located in a depressed area which would reduce slippage over the top of the head. In addition, the ridge formed by the brow should prevent undue slippage over the face.

This line of tension will differ on different users because head shapes and sizes differ. Because of this the headguard typically is adjustable. The headguard disclosed here adjusts in the following ways. First, the rear panel 304 can move up and down and typically left and right in relation to the front panel 302 because the adjustment straps 306 connecting the panels are flexible. This flexibility is enhanced if attachment rings are attached at the rear edge of the front panel 302. Second, the flexibility of the panels, enhanced by the pliability of the padding, the flexing areas, and the vents 326, permit greater conformity to the shape of the head and better retention. For example, the rear panel 304 can flex inward in the area underneath the occipital bone thereby fitting the occipital bone. Third, the four adjustable fasteners on the adjustment straps allow increased or decreased tension to be pinpointed. If, for example, too much tension is placed below the occipital bone and the headguard becomes uncomfortable, either the lower adjustment straps can be loosened or the upper straps can be tightened. Finally, the sizing pads can act as additional means for retention and sizing. In some locations tension cannot be directed sufficiently to bend the panels in such a way that improves retention and sizing. For example, in the depressed area between the brow of the head and the frontal bone it may be difficult to depress the front panel sufficiently to achieve optimal retention. By placing a sizing pad in this area, conformity to the head is increased and the ridge formed by such a sizing pad reduces the likelihood the panel will slip over the top of the head.

As noted above, the present invention provides a headguard which may be used in a number of different sports in which impacts to the head may occur. The present invention should not be considered limited to the particular examples described above, but rather should be understood to cover all aspects of the invention as fairly set out in the attached claims. For example, while suitable materials, fasteners, and the like have been disclosed in the above discussion, it should be appreciated that these are provided by way of example and not of limitation as a number of other materials, fasteners, and so forth may be used without departing from the invention. Various modifications as well as numerous structures to which the present invention may be applicable will be readily apparent to those of skill in the art to which the present invention is directed upon review of the present specification. The claims are intended to cover such modifications and structures.

What is claimed is:

1. A protective headguard comprising:

a central pad for covering a portion of a forehead of a wearer, the central pad having a first side and a second side;

at least a first and second padded rib extending from each side of the central pad, wherein distal ends of the first and second padded ribs on each side are connected to form side portions extending rearward from the central pad for covering sides of the head of the wearer;

a rear pad for covering an occipital bone of the wearer; and an adjustment strap system securing the side portions to the rear pad.

2. The headguard of claim 1, further including first and second straps connected between the rear pad and respective side portions and a second strap connected between the first and second straps for placement under the chin of a wearer.

3. The headguard of claim 1, further including a spine pad extending from the central pad to the rear pad covering a top portion of the head of a wearer, wherein the spine pad, central pad and rear pad are formed from a monolithic piece of molded padding.

4. The headguard of claim 1, wherein each side portion includes a first aperture defined between the respective first and second padded ribs.

5. The headguard of claim 4, further including one or more channels of recessed padding on each side of the central pad, the one or more channels on a respective side extending from a base of the central pad to the aperture defined by the first and second ribs on the respective side.

6. The headguard of claim 5, wherein each of the first padded ribs includes at least one second aperture disposed below a respective one of the first apertures and one or more rib channels extending from the base of the first padded rib to the at least one second aperture.

7. The headguard of claim 1, wherein the adjustment strap system includes an upper adjustment strap system interconnecting a top portion of the rear pad and at least one of the second padded ribs and a lower adjustment strap system interconnecting a bottom portion of the rear pad and at least one of the first padded ribs, wherein the upper and lower adjustment strap systems are independently adjustable.

8. The headguard of claim 1, wherein each of the first padded ribs includes a first thinner area at the distal end and each of the second ribs includes a second thinner area, wherein the first and second thinner areas of respective first and second ribs overlap.

9. The headguard of claim 8, wherein the combined thickness of the overlapping thinner areas is about the same as a thickness of the first or second padded ribs near the thinner areas.

10. The headguard of claim 8, wherein a headstrap system connects respective first and second ribs at the respective thinner areas.

11. The headguard of claim 1, wherein the rear pad includes a center pad and a plurality of top rib portions extending from a top side of the center pad, and a plurality of bottom rib portions extending from a bottom side of the center pad, wherein the rear pad further includes one or more channels disposed between the rear pad and each of the rib portions which allow flexing of the rib portions relative to the center pad.

12. The headguard of claim 11, wherein the adjustment strap system includes an upper adjustment strap which interweaves between distal ends of the top rib portions and connects at each end to each respective side portion and a bottom adjustment strap which interweaves between distal ends of the bottom rib portions and connects at each end to each respective side portion.

13. The headguard of claim 1, wherein the rear pad includes a center pad and two top ribs each extending from a respective top side of the center pad and two bottom ribs each extending from a respective bottom side of the center pad, wherein the rear pad further includes one or more apertures between the center pad and each of the top and bottom ribs which facilitate flexing of the ribs relative to the center pad.

14. The headguard of claim 13, wherein the adjustment strap system includes two independently adjustable upper adjustment straps each interconnecting one of the two top ribs to one of the side portions and two independently adjustable lower adjustment straps each interconnecting one of the two lower ribs to one of the side portions.

15. The headguard of claim 1, wherein the rear pad includes a center pad for covering an occipital bone of the wearer and a larger sizing pad disposed below the center pad for positioning below the occipital bone and securing the headguard to the head of the wearer.

16. The headguard of claim 15, wherein the adjustment strap system includes at least one adjustment strap and the sizing pad aligns with the at least one adjustment straps.

17. The headguard of claim 1, wherein the rear pad includes a center pad and a flange extending from each side of the center pad, each flange including a middle rib extending outward from a respective side of the center pad and having a first end away from the respective side, an upper rib interconnected between the first end and an upper portion of the respective side, and a lower rib interconnected between the first end and a lower portion of the respective side, wherein the middle rib and upper rib of each flange form an aperture and wherein the middle rib and lower rib of each flange form an aperture.

18. The headguard of claim 1, wherein each of the first ribs further includes a bottom edge with a recessed portion for exposing an ear of the wearer, wherein the first aperture defined by a respective one of the first ribs is disposed closer to the central pad than the recessed portion of the respective one of the first ribs.

19. The headguard of claim 18, further including, on each side first rib, a downwardly extending portion disposed between the respective recessed portion and the central pad for covering a temple of the wearer.

20. The headguard of claim 1, further including one or more channels disposed between each of the second ribs and the central pad for increasing flexing between the second ribs and the central pad.

21. The headguard of claim 1, wherein a headstrap system, the rear pad and the central pad provide a line of tension which runs below the occipital bone of the wearer and below the frontal bone of the wearer when the headguard is worn by the wearer.

22. The headguard of claim 1, further including a v-shaped channel disposed on the central pad and defining a header target location, the v-shaped channel being spaced equally from side edges of the central pad and facilitating flexing of the central pad.

23. A protective headguard comprising:

a central pad for covering a portion of a forehead of a wearer;

a pair of first padded ribs each extending from a respective side of the central pad and, each first padded rib including a large area with a thicker padding thickness and a distal end having a thinner area of a thinner padding thickness;

a pair of second padded ribs each extending from a respective side of the central pad above a respective one of the first padded ribs, each second padded rib including a large area with the thicker padding thickness and a distal end having a thinner area of a thinner padding thickness, wherein the thinner areas of respective first and second ribs overlap and wherein the combined thickness of the overlapping thinner areas is about the same as the thicker padding thickness;

a rear pad for covering an occipital bone of the wearer;

an upper adjustment strap system interconnecting an upper portion of the rear pad to upper portions of the side portions; and a lower adjustment strap system interconnecting a lower portion of the rear pad to lower portions of the side portions.

24. The headguard of claim 23, wherein each of the thinner areas includes a slot and wherein the upper adjustment strap system includes two strap portions each disposed through the slots of the thinner areas of respective first and second ribs for connecting respective first and second ribs.

25. A method of manufacturing a protective headguard, comprising:

forming a planar pad having a central pad and first and second padded ribs extending from each side of the central pad;

bending the first and second padded ribs on each side to contact a distal end of one of the first padded ribs with a distal end of a respective one of the second padded ribs; and securing the contacted distal ends of respective first and second padded ribs to form a multidimensional pad from the planar pad having side portions extending rearward of the central pad for covering sides of the head of a wearer.

26. The method of claim 25 wherein forming the planar pad includes forming one or more channels between each first rib and the central pad and wherein bending the first and second padded ribs on each side includes bending each of the first padded ribs along the one or more channels between the respective first rib and the central pad.

27. The method of claim 25, wherein forming the planar pad includes forming one or more channels between each second rib and the central pad and wherein bending the first and second padded ribs on each side includes bending each of the first second ribs along the one or more channels between the respective second rib and the central pad.

28. The method of claim 25, wherein bending the first and second padded ribs includes bending the central portion.

29. The method of claim 25, wherein:

forming the planar pad forming a first thinner area at the distal end of each of the first padded ribs and a second thinner area at the distal end of each of the second rib; and bending the first and second ribs includes overlapping the first and second thinner areas of respective first and second ribs.

30. A protective headguard to be worn by an athlete, comprising:

a) a protective central pad having an exterior surface, and configured and arranged to cover at least a portion of the athlete's forehead and lateral frontalis when the headguard is worn;

b) perceptible lines of demarcation visually separating an otherwise continuous area of the headguard on the exterior surface of the central pad beginning proximate the lateral frontalis and extending towards the brow when the headguard is worn;

c) a rear pad configured and arranged to cover at least a portion of the athlete's occipital bone when the headguard is worn; and (d) an adjustable strap system interconnecting the rear pad and the central pad.

* * * * *